US010718097B2

(12) United States Patent
Hren et al.

(10) Patent No.: US 10,718,097 B2
(45) Date of Patent: Jul. 21, 2020

(54) SHOVEL HANDLE WITH BAIL OVER DIPPER FEATURE

(71) Applicant: Harnischfeger Technologies, Inc., Wilmington, DE (US)

(72) Inventors: William J. Hren, Wauwatosa, WI (US); Ethan J. Pedretti, Holmen, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 315 days.

(21) Appl. No.: 15/612,492

(22) Filed: Jun. 2, 2017

(65) Prior Publication Data

US 2017/0350089 A1 Dec. 7, 2017

Related U.S. Application Data

(60) Provisional application No. 62/345,528, filed on Jun. 3, 2016.

(51) Int. Cl.

| | |
|---|---|
| ***E02F 3/30*** | (2006.01) |
| ***E02F 3/54*** | (2006.01) |
| ***E02F 3/48*** | (2006.01) |
| ***E02F 3/38*** | (2006.01) |
| ***E02F 3/40*** | (2006.01) |
| ***E02F 9/14*** | (2006.01) |
| ***E02F 9/28*** | (2006.01) |
| *E02F 9/00* | (2006.01) |
| *E02F 9/22* | (2006.01) |

(52) U.S. Cl.

CPC ..... *E02F 3/308* (2013.01); *E02F 3/38* (2013.01); *E02F 3/40* (2013.01); *E02F 3/48* (2013.01); *E02F 3/54* (2013.01); *E02F 9/14* (2013.01); *E02F 9/2808* (2013.01); *E02F 9/006* (2013.01); *E02F 9/2271* (2013.01)

(58) Field of Classification Search

CPC ..... E02F 3/30; E02F 3/308; E02F 3/38; E02F 3/40; E02F 3/425; E02F 3/48; E02F 3/54; E02F 9/14; E02F 9/2271; E02F 9/006; E02F 9/2808

See application file for complete search history.

(56) References Cited

U.S. PATENT DOCUMENTS

| | | | | |
|---|---|---|---|---|
| 2,652,940 A | | 9/1953 | Brolin et al. | |
| 3,402,486 A | * | 9/1968 | Branson | E02F 3/40 37/444 |
| 3,485,395 A | * | 12/1969 | Windahl | E02F 3/32 414/694 |
| 4,339,225 A | * | 7/1982 | Donnally | E02F 3/42 414/690 |

(Continued)

OTHER PUBLICATIONS

Examination Report issued from the Chilean Patent Office for related Application No. 201701413 dated Aug. 1, 2018 (10 pages including Statement of Relevance).

*Primary Examiner* — Jessica H Lutz
(74) *Attorney, Agent, or Firm* — Micheal Best & Friedrich LLP

(57) ABSTRACT

A mining machine includes a frame, a boom coupled to the frame, a handle coupled to the frame and a dipper coupled to the handle. The handle includes an extension, and a bail is coupled directly to the extension, such that the bail is isolated from the dipper.

22 Claims, 18 Drawing Sheets

(56) References Cited

U.S. PATENT DOCUMENTS

| | | | | |
|---|---|---|---|---|
| 5,499,463 | A * | 3/1996 | Profio | E02F 3/304 37/398 |
| 6,434,862 | B1 * | 8/2002 | Hren | E02F 3/304 37/398 |
| 9,015,969 | B2 | 4/2015 | Knuth | |
| 2012/0195730 | A1 * | 8/2012 | Hren | E02F 3/304 414/723 |
| 2013/0195594 | A1 | 8/2013 | Knuth | |
| 2013/0280021 | A1 * | 10/2013 | Knuth | E02F 9/2275 414/718 |
| 2014/0271075 | A1 * | 9/2014 | Pusheck | E02F 3/308 414/694 |
| 2015/0147146 | A1 | 5/2015 | Hren et al. | |
| 2017/0167115 | A1 * | 6/2017 | Lee | E02F 3/308 |
| 2017/0260857 | A1 * | 9/2017 | Gross | E21C 47/00 |
| 2017/0298592 | A1 * | 10/2017 | Akanda | E02F 3/308 |
| 2017/0350089 | A1 * | 12/2017 | Hren | E02F 3/48 |

* cited by examiner

SHOVEL HANDLE WITH BAIL OVER DIPPER FEATURE

CROSS-REFERENCE TO RELATED APPLICATIONS

This application claims priority to U.S. Provisional Application No. 62/345,528, filed Jun. 3, 2016, the entire contents of which are incorporated herein by reference.

FIELD OF THE INVENTION

The present invention relates to mining machines, and specifically mining shovels having a handle and a dipper.

Industrial mining machines, such as electric rope or power shovels, draglines, etc., are used to execute digging operations to remove material from a bank of a mine. On a conventional rope shovel, a dipper is attached to a handle, and the dipper is supported by a cable, or rope, that passes over a boom sheave. The rope is secured to a bail and/or equalizer that is coupled to the dipper. The handle is moved along a saddle block to maneuver a position of the dipper. During a hoist phase, the rope is reeled in by a winch in a base of the machine, lifting the dipper upward through the bank and liberating the material to be dug. To release the material disposed within the dipper, a dipper door is sometimes pivotally coupled to the dipper. When not latched to the dipper, the dipper door pivots away from a bottom of the dipper, thereby freeing the material out through a bottom of the dipper. Dippers often must be replaced due to wear and/or fatigue.

SUMMARY

In accordance with one construction, a mining machine includes a frame, a boom coupled to the frame, a handle coupled to the frame and a dipper coupled to the handle. The handle includes an extension, and a bail is coupled directly to the extension, such that the bail is isolated from the dipper.

In accordance with another construction, a mining machine includes a frame, a boom coupled to the frame, a sheave coupled to an end of the boom, a handle coupled to the frame, a dipper pivotally coupled to the handle, and a tilt mechanism coupled to both the handle and the dipper. The handle includes an extension such that the handle has a non-linear profile. A bail is coupled directly to the extension such that the bail is isolated from the dipper. An equalizer is coupled to the bail, and a hoist rope is coupled to the equalizer and to the sheave.

Other aspects of the invention will become apparent by consideration of the detailed description and accompanying drawings.

DETAILED DESCRIPTION

Figure 1:
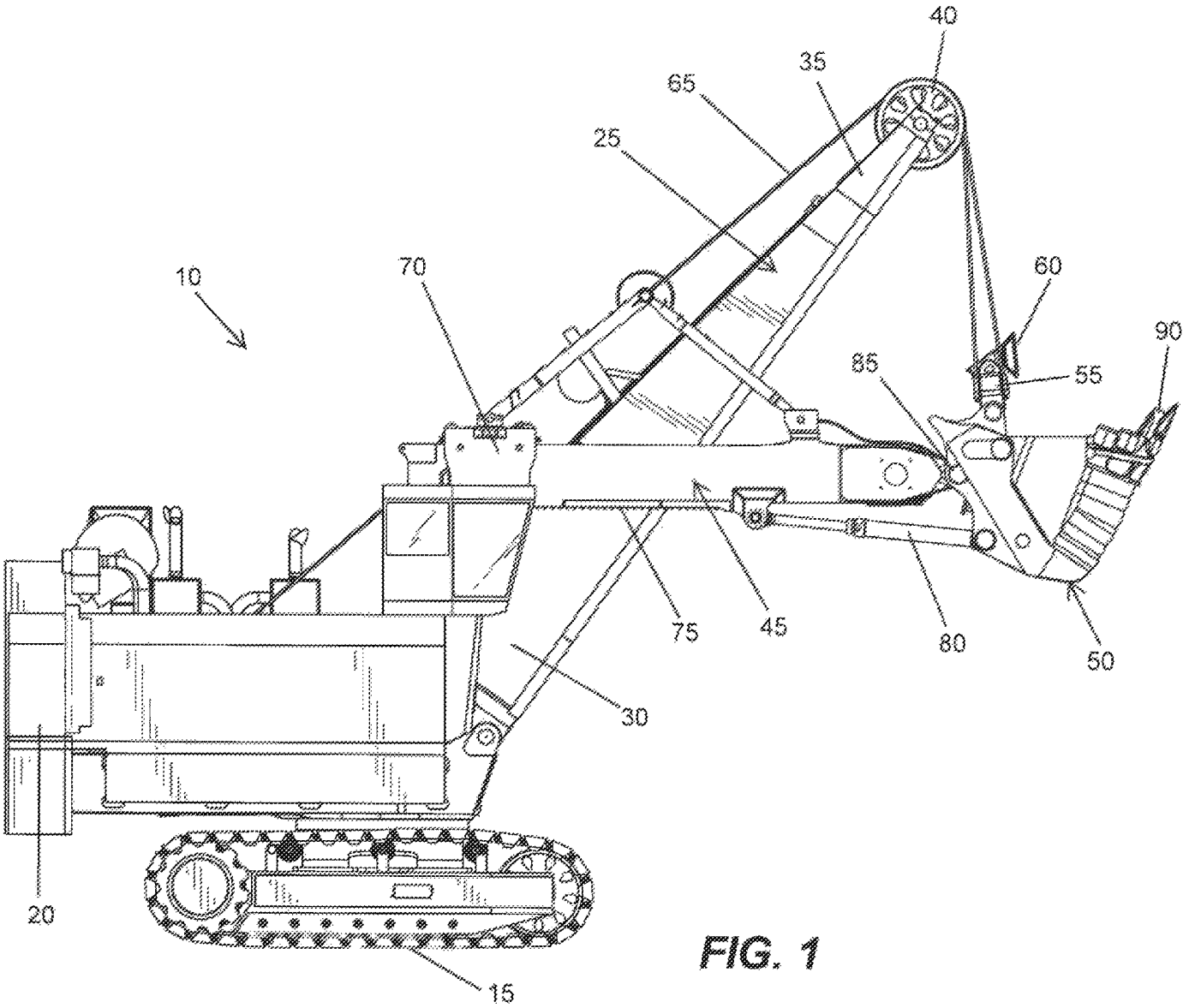
FIG. 1 is a side view of a mining machine having a handle, a dipper pivotally coupled to the handle, a tilt mechanism coupled to both the handle and the dipper, a bail coupled to the dipper, an equalizer coupled to the bail, and a hoist rope coupled to the equalizer.
Figure 2:
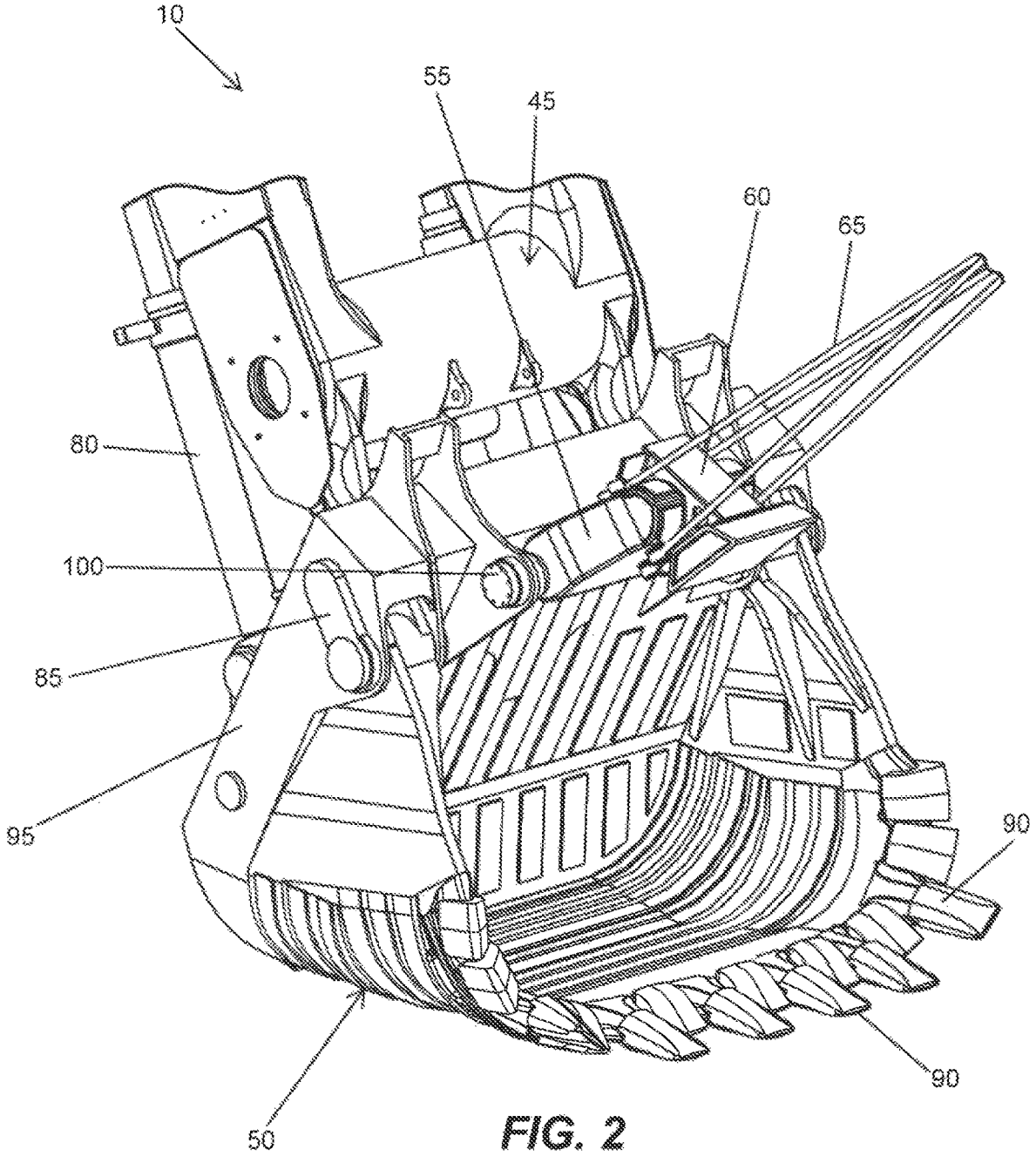
FIG. 2 is a partial, perspective view of the mining machine of FIG. 1, further illustrating the bail and the equalizer.

FIGS. 1-6 illustrate a power shovel 10. With reference to FIGS. 1 and 2, the power shovel 10 includes drive tracks 15, a frame 20 (e.g., revolving) coupled to the drive tracks 15, and a boom 25 coupled to the frame 20. The boom 25 includes a lower end 30 (also called a boom foot), and an upper end 35 (also called a boom point). The power shovel 10 also includes a sheave 40 rotatably mounted on the upper end 35 of the boom 25, a handle 45 coupled to the frame 20, a dipper 50 coupled to the handle 45, a bail 55 coupled to the dipper 50, an equalizer 60 coupled to the bail 55, and a hoist rope 65 coupled to the frame 20 (e.g., to a winch drum). The hoist rope 65 is wrapped over the sheave 40 and coupled to the equalizer 60.

As the winch drum rotates, the hoist rope 65 is paid out to lower the dipper 50 or pulled in to raise the dipper 50. The handle 45 is slidably supported in a saddle block 70, and the saddle block 70 is pivotally mounted to the frame 20 (e.g., at a shipper shaft, not shown). The handle 45 includes a rack and tooth formation 75 thereon that engages a drive pinion (not shown) mounted in the saddle block 70. The drive pinion is driven by an electric motor and crowd transmission unit (not shown) to extend or retract the handle 45 relative to the saddle block 70.

The shovel 10 also includes at least one tilt mechanism 80 (e.g., hydraulic cylinder, pneumatic cylinder, etc.) that is coupled to both the handle 45 and to the dipper 50. In the illustrated construction, the tilt mechanism 80 is a hydraulic cylinder. When activated in a first direction (FIG. 3), the tilt mechanism 80 extends to tilt the dipper 50 about a pivot point 85 (e.g., a pivot pin) such that teeth 90 of the dipper 50 rise. The pivot point 85 is a pivotal connection between the handle 45 and the dipper 50. When activated in a second direction (FIG. 4), the tilt mechanism 80 retracts to tilt the dipper 50 about the pivot point 85 such that the teeth 90 of the dipper 50 lower. Thus, the dipper 50 may be tilted by the tilt mechanism 80 about the pivot point 85, and may be raised and lowered by the hoist rope 65.

One or more electrical power sources (not shown) are also mounted to the frame 20 to provide power to one or more crowd electric motors (not shown) for driving the crowd transmission unit, and to provide power to the winch drum (not shown) coupled to the frame 20. One or more hydraulic sources (not shown) are also coupled to the frame 20 to provide power to one or more hydraulic tilt mechanisms 80 for driving the tilt of the dipper 50. Each of the crowd electric motors and the hydraulic tilt mechanism 80 is driven by one or more motor controllers, or is alternatively driven in response to control signals from a controller (not shown).

Figure 3:
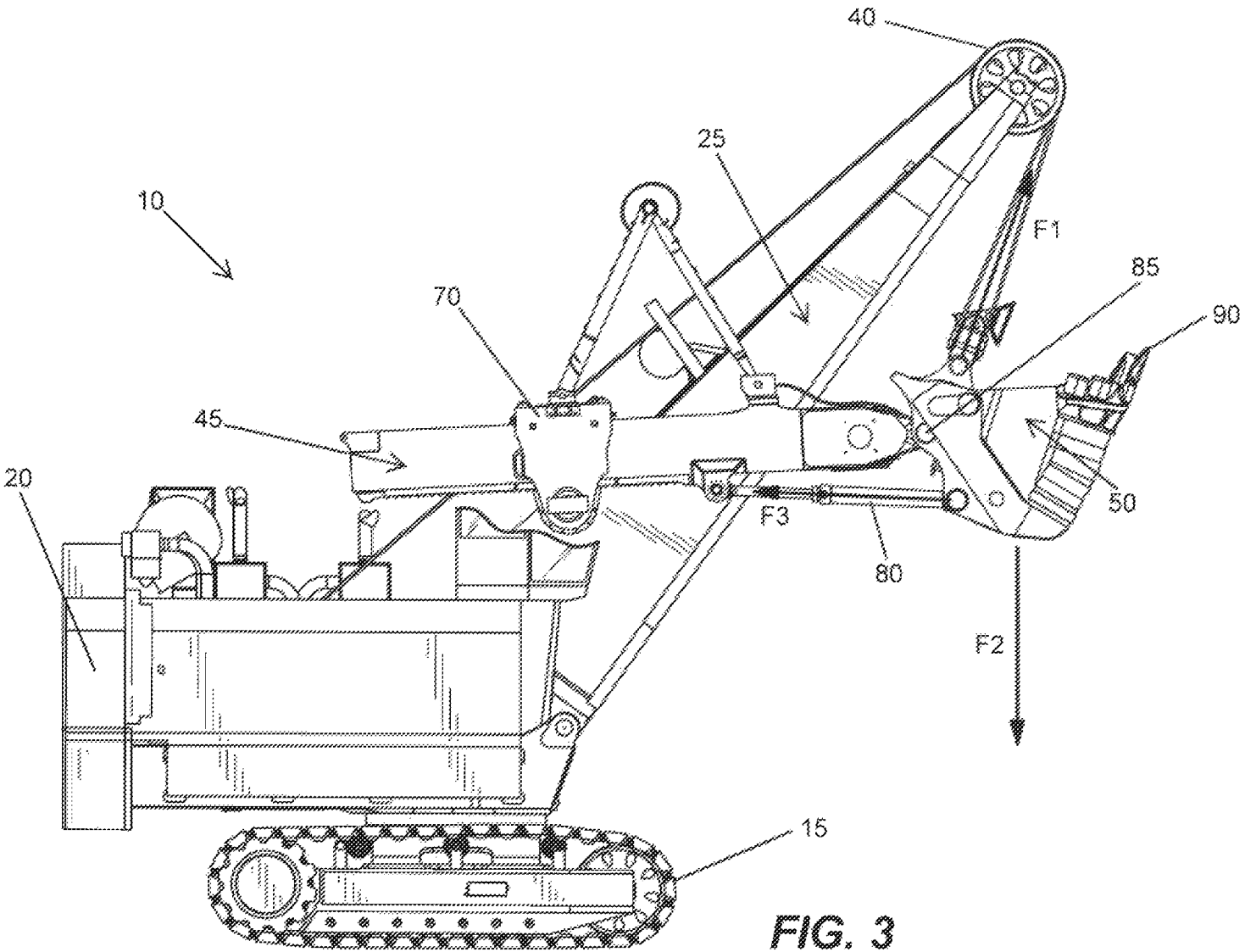
FIG. 3 is a side view of the mining machine of FIG. 1, illustrating a negative cylinder load in an extended position of the dipper.

With reference to FIG. 3, when the tilt mechanism 80 has been activated in the first direction, the tilt mechanism 80 reaches a fully extended position, with the teeth 90 raised. In this position, as illustrated in FIG. 3, a tension force F1 generated by the hoist rope 65, combined with a force of gravity F2, creates a resultant force F3 on the tilt mechanism 80. When the tilt mechanism 80 begins to move in the second direction (i.e., begins to move toward the fully retracted position in FIG. 4, otherwise commonly referred to as "tucking"), this force F3 acts as a negative load on the tilt mechanism 80. A negative load occurs for example when a hydraulic cylinder is driven in the same direction as the load applied to it. Thus, as the hydraulic cylinder of the tilt mechanism 80 is driven via a power source generally to the left in FIG. 3, the force F3 acts in the same direction, resulting in a negative load on the hydraulic cylinder. If there is not enough fluid pressure in the tilt mechanism 80 to resist this negative load, fluid cavitation and/or runaway speed may result. Hydraulic controls of the tilt mechanism 80 therefore provide back pressure (e.g., constant back pressure) to control against fluid cavitation. Use of back pressure in the cylinder to prevent cavitation and/or runaway, however, may reduce hydraulic efficiency, cause greater energy consumption, and/or reduce peak forces in the hydraulic cylinder.

Figure 4:
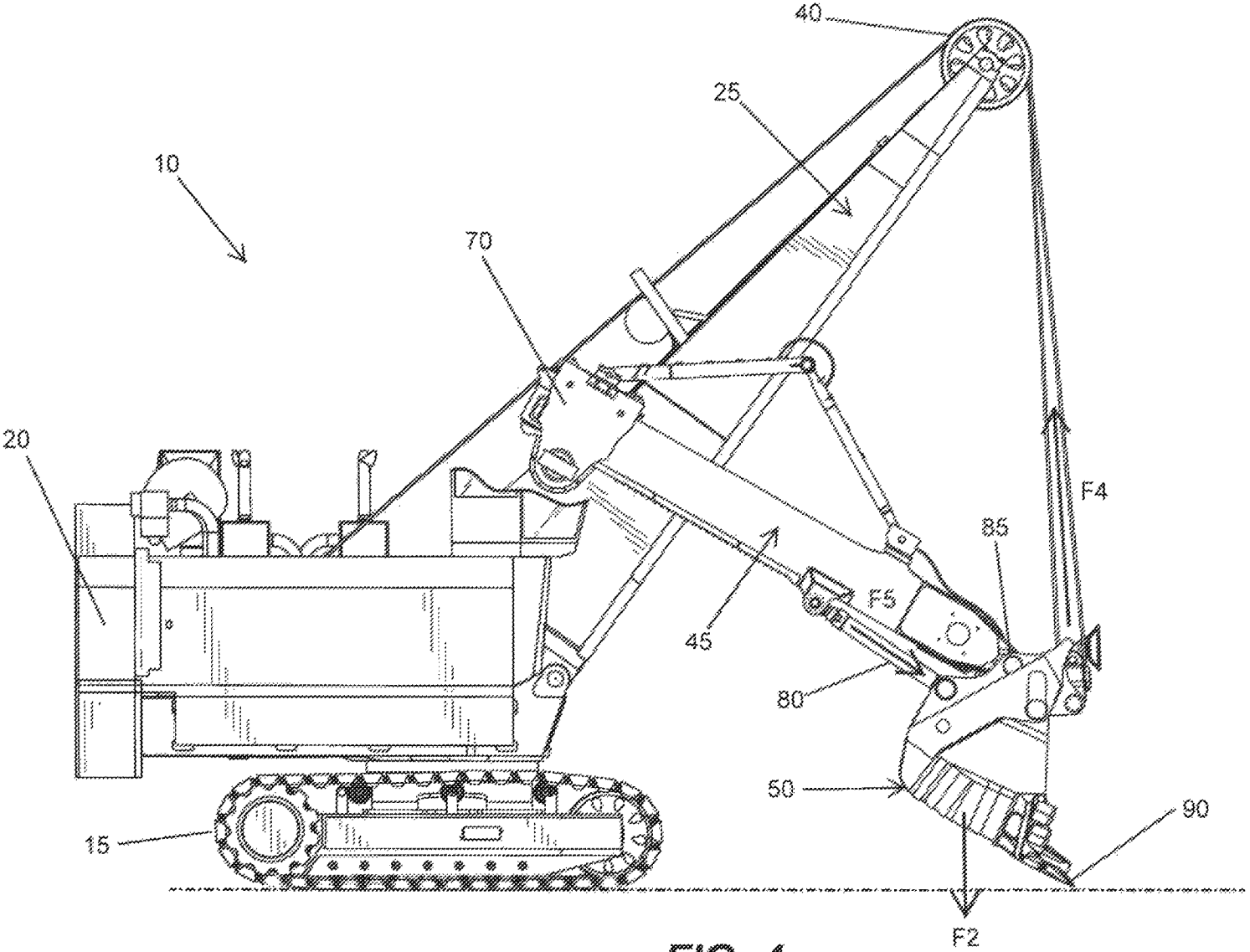
FIG. 4 is a side view of the mining machine of FIG. 1, illustrating a negative cylinder load in a retracted position of the dipper.

With reference to FIG. 4, when the tilt mechanism 80 has been activated in the second direction, the tilt mechanism 80 reaches a fully retracted or tucked position, with the teeth 90 lowered and approaching but not contacting the ground. In this position, a tension force F4 generated by the hoist rope 65, combined with the force of gravity F2, creates a force F5 on the tilt mechanism 80. When the tilt mechanism 80 begins to move in the first direction (i.e., begins to move toward the fully extended position in FIG. 3), this force F5 acts as a negative load on the tilt mechanism 80, since the force F5 is acting in the same direction as the movement of the hydraulic cylinder. Again, if there is not enough fluid pressure in the tilt mechanism 80 to resist this negative load, fluid cavitation and/or runaway speed can result.

Figure 5:
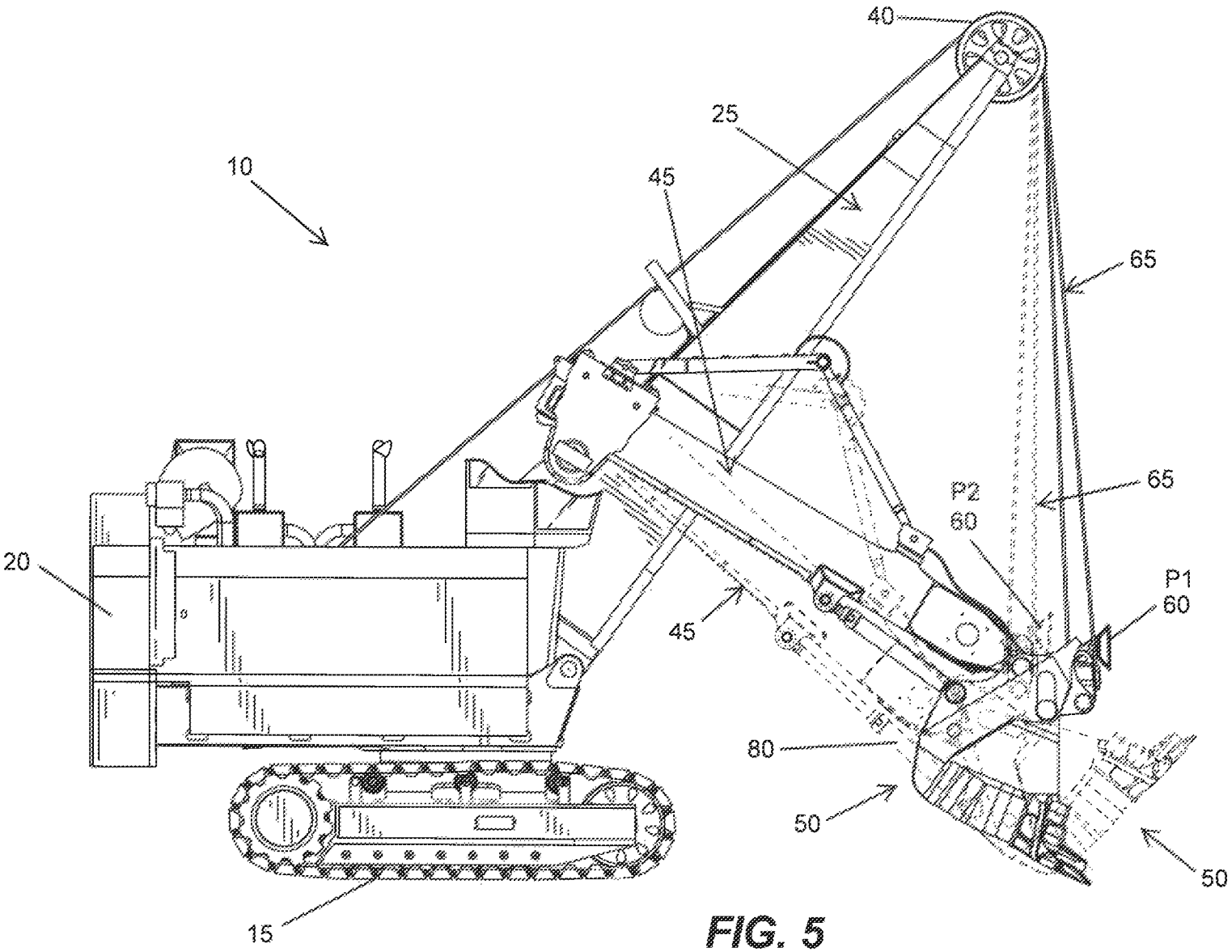
FIG. 5 is a side view of the mining machine of FIG. 1, illustrating a handle drop condition.

With reference to FIG. 5, a slight, uncontrolled movement of the dipper 50 also occurs when the hoist rope 65 and the crowding of the handle 45 are kept constant (i.e., when the drive pinion and winch drum are not rotated), and the dipper 50 is tilted via the tilt mechanism 80 (e.g., after the end of an initial bank penetration). There are two scenarios illustrating the uncontrolled effects of tilting a dipper when a hoist rope is connected directly to a dipper that is allowed to pivot. Scenario 1 occurs when the dipper is simply suspended from the hoist rope without a bottom of the dipper resting on a bank of material. For example, as illustrated in FIG. 5, tilting of the dipper 50 causes the equalizer 60 to move from a first position P1 to a second position P2. For a given angle of the handle 45, therefore, if the tilt motion is extended (i.e., the tilt mechanism 80 extends toward the fully extended position), excess hoist rope 65 for that given handle angle is created. If there is nothing holding the dipper 50 in place as in Scenario 1, as the tilt motion is extended, the handle 45 will simply rotate downward, pivoting about the shipper shaft. This rotation will result in dropping the handle 45 down (e.g., in some constructions by approximately 8.6° as seen in FIG. 5), which affects operator control of the dipper 50 and decreases an overall available range of tilt for the dipper 50 (e.g., decreases the range to only 73% of the overall available range of tilt).

In Scenario 2 (not shown) the dipper in P1 is supported underneath by material and cannot drop downward as it is already resting on a bank of material, the ground, or another material or object. Tilting of the dipper 50 causes the equalizer 60 to again move from a first position P1 to a second position P2. However, since the dipper cannot drop downward, this movement now generates a slack in the hoist rope 65 (e.g., in some constructions, a slack of 2% of rope payout). Slack hoist rope is undesirable in that there can now be sudden uncontrolled hoist take up of the rope causing erratic hoist control of the dipper bail 55 and equalizer 60 resulting in possible damage to the hoist ropes due to the sudden dynamic loads. Slack hoist ropes can also cause the ropes themselves to jump the sheave 40.

Figure 6:
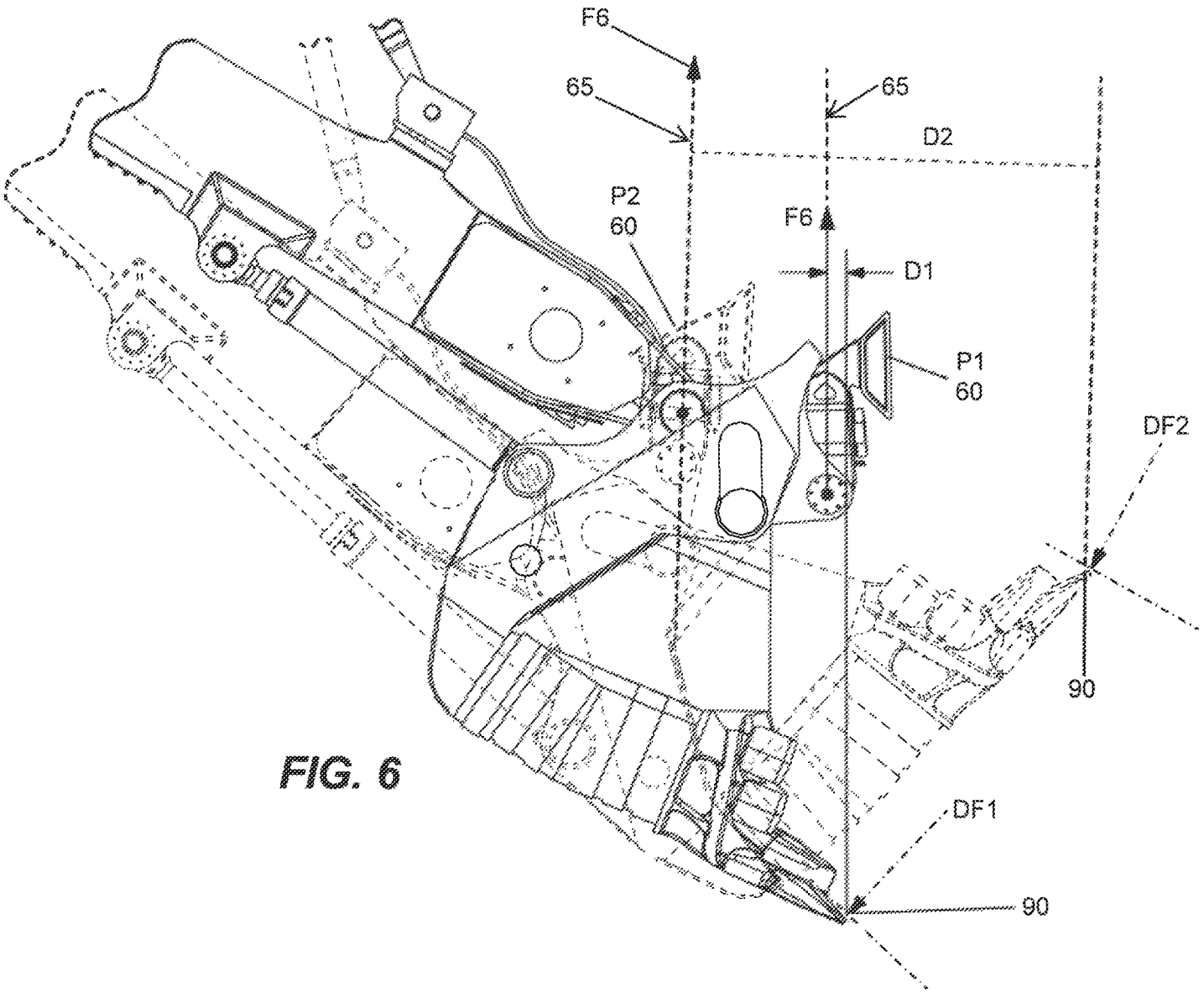
FIG. 6 is a partial side view of the mining machine of FIG. 1, illustrating an available digging force that depends on a tilted position of the dipper.

With reference to FIG. 6, an available tooth digging force (i.e., cutting force) also changes depending upon a tilted position of the dipper 50. For example, as illustrated in FIG. 6, when the equalizer 60 is in the first position P1, a distance D1 exists between a tension force F6 on the hoist rope 65 and the front of the teeth 90 (the distance D1 extending perpendicularly from F6 to a solid line that is parallel to F6 and contacts the front of the teeth 90). Because of this small distance D1, an available tooth digging force DF1 is high. When the dipper 50 is tilted and the equalizer 60 is in the position P2, a distance D2 exists between the tension force F6 and the front of the teeth 90 (the distance D2 extending perpendicularly from F6 to a dashed line that is parallel to F6 and contacts the front of the teeth 90). The distance D2 is significantly larger than the distance D1, resulting in a greatly reduced available tooth digging force DF2 when the equalizer is in position P2. The tooth digging dig forces DF1 and DF2 are each increased in the event of applying the newly disclosed handle extension 295 (described below).

With reference to FIG. 2, the bail 55 and/or equalizer 60 are also subject to bending loads due to dipper corner tooth loading. As a result, the bail 55 and/or equalizer 60 must be made large enough, and of strong enough material, to withstand stresses originating from these bending loads. Additionally, the dipper 50 includes a back section 95. This back section 95 must be made large enough, and of strong enough material, to handle high hoist bail forces acting through a load path between the pivot point 85 and a further pivot point 100 where the bail 55 is coupled to the dipper 50.

FIGS. 7-10 illustrate a power shovel 210. The power shovel 210 is similar to the power shovel 10 described above. For example, the shovel 210 includes drive tracks 215, a frame 220 (e.g., revolving) coupled to the drive tracks 215, and a boom 225 coupled to the frame 220. The boom 225 includes a lower end 230 (also called a boom foot), and an upper end 235 (also called a boom point). The power shovel 210 also includes a sheave 240 rotatably mounted on the upper end 235 of the boom 225, a handle 245 coupled to the frame 220, a dipper 250 coupled to the handle 245, a bail 255, an equalizer 260 coupled to the bail 255, and a hoist rope 265 coupled to the frame 220 (e.g., to a winch drum). The hoist rope 265 is wrapped over the sheave 240 and coupled to the equalizer 260.

As the winch drum rotates, the hoist rope 265 is paid out to lower the dipper 250 or pulled in to raise the dipper 250. The handle 245 is slidably supported in a saddle block 270, and the saddle block 270 is pivotally mounted to the frame 220 (e.g., at a shipper shaft, not shown). The handle 245 includes a rack and tooth formation 275 thereon that engages a drive pinion (not shown) mounted in the saddle block 270. The drive pinion is driven by an electric motor and crowd transmission unit (not shown) to extend or retract the handle 245 relative to the saddle block 270.

The shovel 210 also includes at least one tilt mechanism 280 (e.g., hydraulic cylinder, pneumatic cylinder, etc.) that is coupled to both the handle 245 and to the dipper 250. When activated in a first direction, the tilt mechanism 280 extends to tilt the dipper 250 about a pivot point 285 (e.g., a pivot pin) such that teeth 290 of the dipper 250 rise. The pivot point 285 is a pivotal connection between the handle 245 and the dipper 250. When activated in a second direction, the tilt mechanism 280 retracts to tilt the dipper 250 about the pivot point 285 such that the teeth 290 of the dipper 250 lower. Thus, the dipper 250 may be tilted by the tilt mechanism 280 about the pivot point 285, and may be raised and lowered by the hoist rope 265.

One or more electrical power sources (not shown) are also mounted to the frame 220 to provide power to one or more crowd electric motors (not shown) for driving the crowd transmission unit, and to provide power to the winch drum (not shown) coupled to the frame 220. One or more hydraulic sources (not shown) are also coupled to the frame 220 to provide power to one or more hydraulic tilt mechanisms 280 for driving the tilt of the dipper 250. Each of the crowd electric motors and the tilt mechanism 280 is driven by one or more motor controllers, or is alternatively driven in response to control signals from a controller (not shown).

Figure 7:
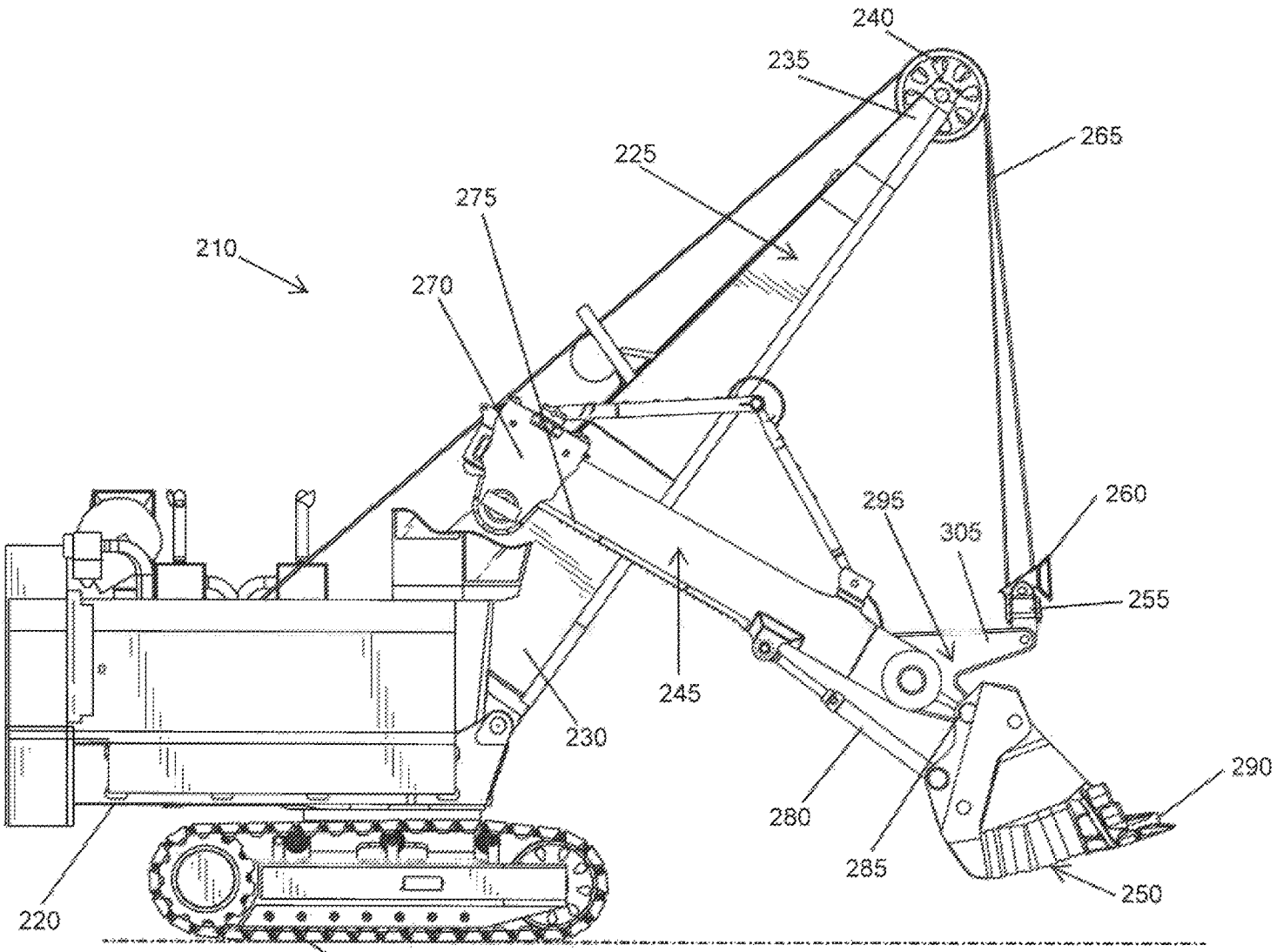
FIG. 7 is a side view of a mining machine according to one construction having a handle, a dipper pivotally coupled to the handle, a tilt mechanism coupled to both the handle and the dipper, a bail coupled to an extension of the handle, an equalizer coupled to the bail, and a hoist rope coupled to the equalizer.

With continued reference to FIGS. 7-10, instead of the bail 255 being directly coupled (e.g., pivotally coupled) to the dipper 250 (see, e.g., FIGS. 1-6), the bail 255 is instead directly coupled to the handle 245. In the illustrated construction, the handle 245 includes an extension 295 (e.g., end projection) that extends over at least a portion of the dipper 250. The extension 295 is integrally formed in one piece with the rest of the handle 245. The extension 295 extends at an angle relative to a remainder of the handle 245, such that the handle 245 has a non-linear profile. In other constructions, the extension 295 is a separate piece that is coupled to (e.g., fastened) the rest of the handle 245. As illustrated in FIG. 7, because the bail 255 is coupled directly to the extension 295, the bail 255 does not directly contact the dipper 250, and is spaced from the dipper 250.

Figure 8:
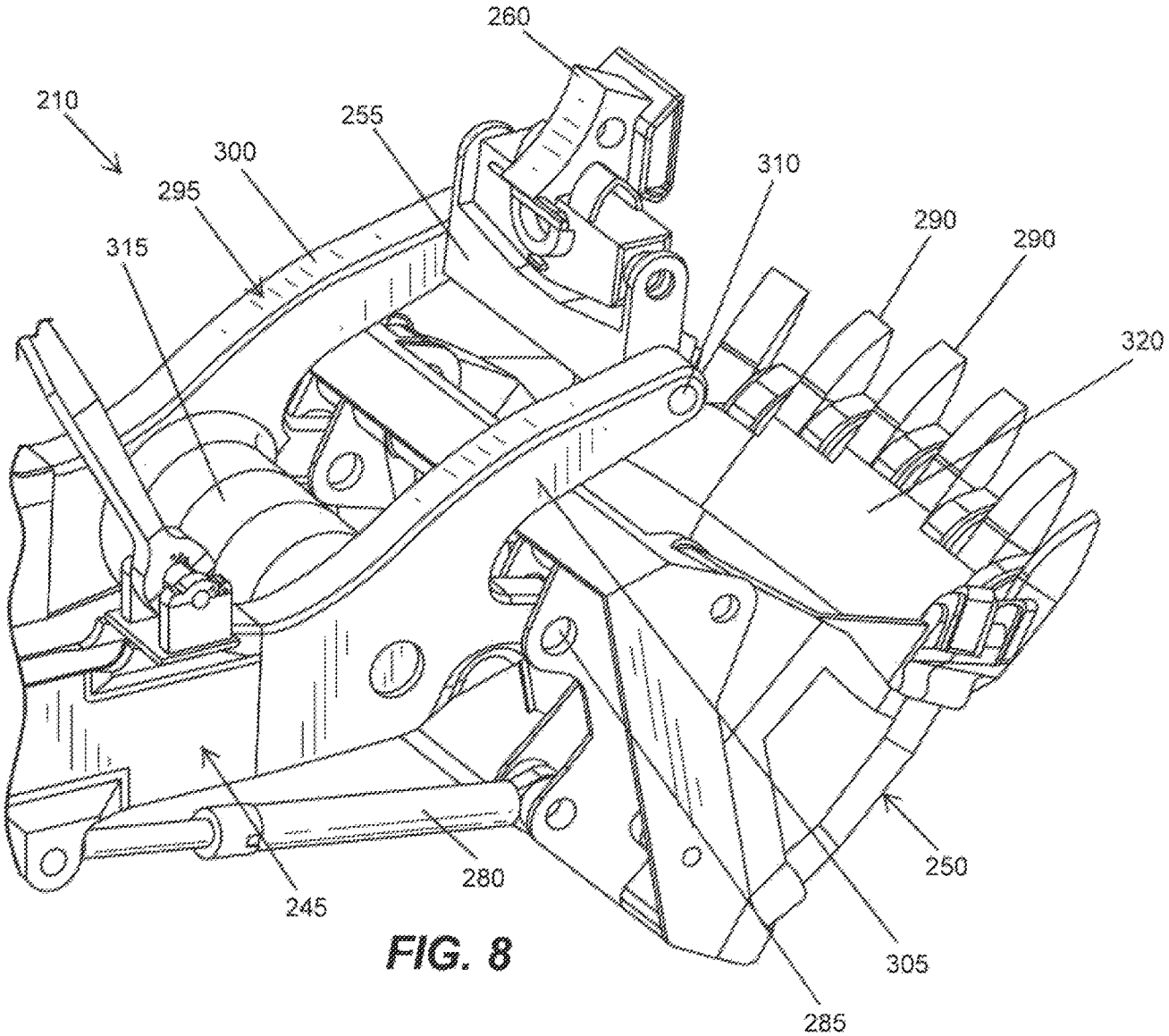
FIG. 8 is a partial, perspective view of the mining machine of FIG. 7, further illustrating the handle and the dipper.

With reference to FIG. 8, in the illustrated construction, the extension 295 includes a first arm 300 and a second arm 305. The arms 300, 305 are pivotally coupled to the bail 255 at pivot points 310 (one illustrated in FIG. 8), such that the bail 255 is disposed between the two arms 300, 305 and pivots relative to the two arms 300, 305 and the rest of the handle 245.

With continued reference to FIG. 8, the two arms 300, 305 are on opposite sides of a torsion tube 315 of the handle 245, and extend generally parallel to one another. While the torsion tube 315 is illustrated as a tubular structure, in other constructions the torsion tube 315 may have other shapes and/or sizes. In other constructions, the two arms 300, 305 are positioned closer to one another (e.g., directly above and/or adjacent the torsion tube 315, resulting in a smaller, lighter bail 255 and/or equalizer 260), or farther apart from one another than illustrated. In some constructions, the two arms 300, 305 do not extend generally parallel to one another. Rather, the two arms 300, 305 define axes that form a non-zero angle relative to one another. In some constructions, only a single arm, or more than two arms, are disposed on the extension 295. In the illustrated construction, the arms 300, 305 have a slight, curved profile, such that the arms 300, 305 extend up and over a portion of the dipper 250. In other constructions, the arms 300, 305 have a straight profile, or form a series of interconnected portions each having straight and/or curved profiles. In some constructions, the extension 295 includes the two arms 300, 305, as well as one or more plates, ribs, or other structures coupled to the arms 300, 305 to provide further support for the extension 295.

Figure 9:
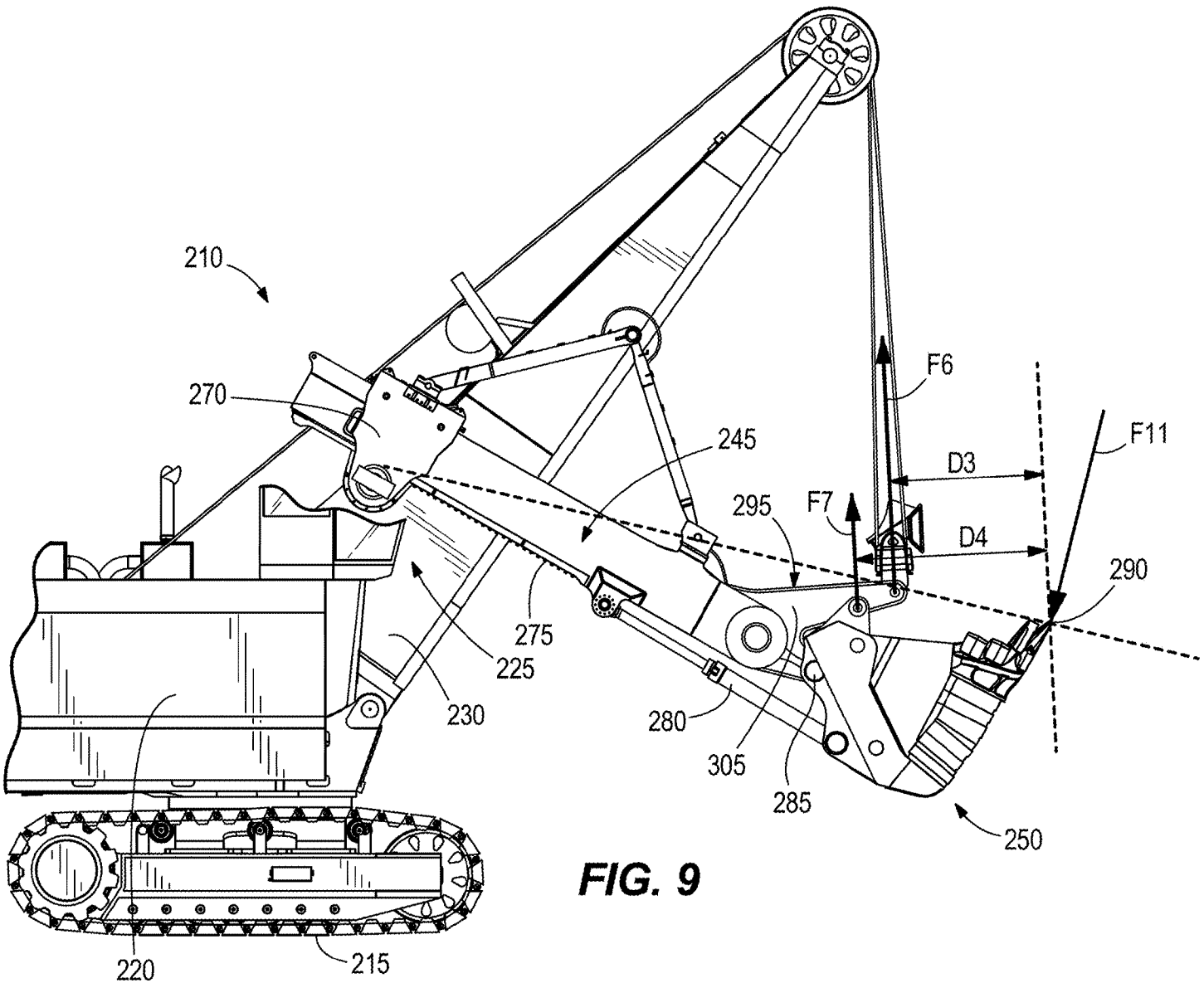
FIGS. 9 and 10 are partial side views of the mining machine of FIG. 7, illustrating available digging forces that depend on a tilted position of the dipper for a hoist rope/bail/equalizer mounted to the dipper versus mounted to the extension/handle.
Figure 10:
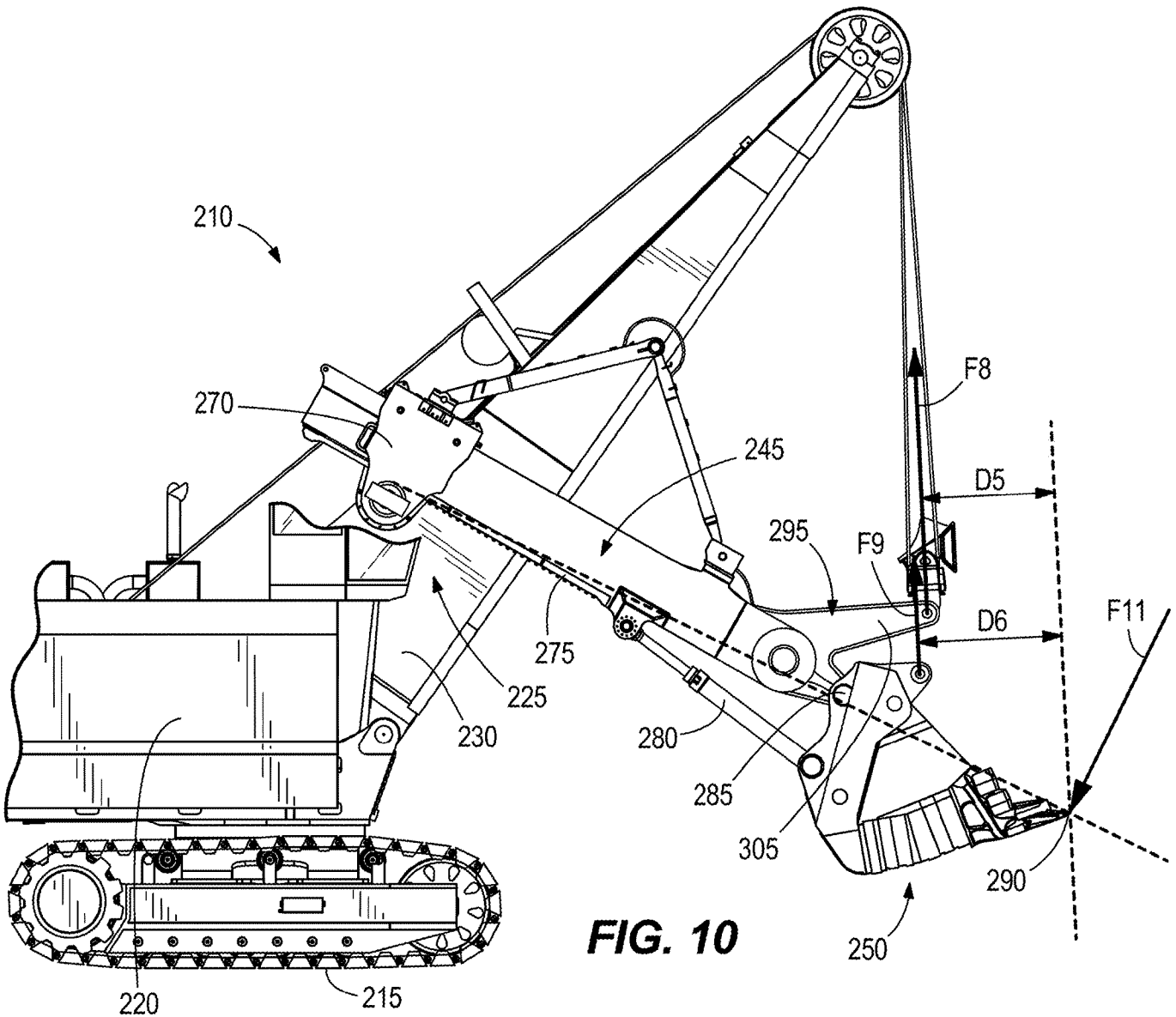
Figure 11:
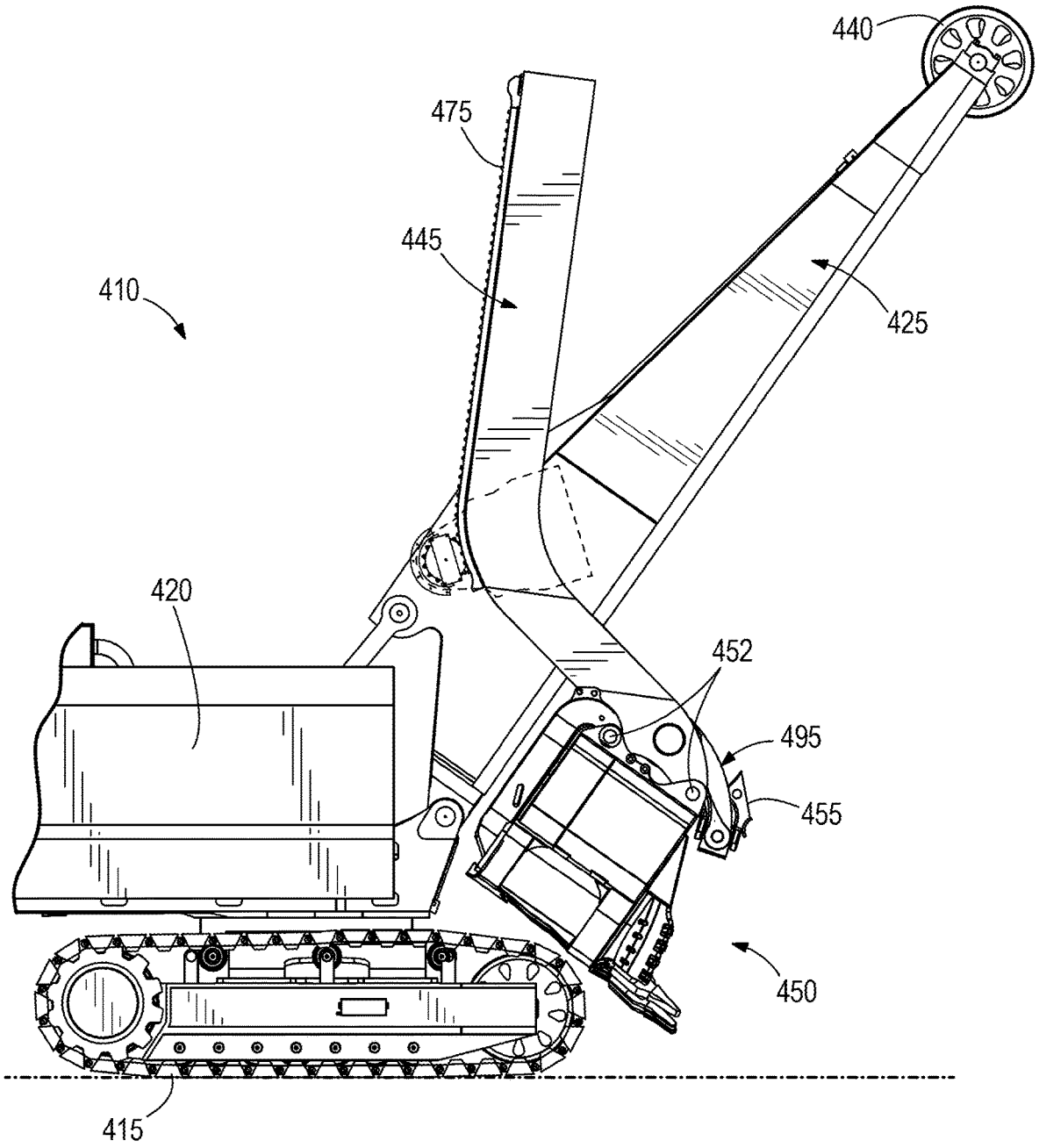
FIGS. 11-15 are perspective views of a mining machine according to another construction.

With reference to FIGS. 9 and 10, when the tilt mechanism 280 is activated in the first direction (FIG. 9), the tilt mechanism 280 extends to tilt the dipper 250 about the pivot point 285 such that teeth 290 of the dipper 250 rise. When activated in the second direction (FIG. 10), the tilt mechanism 280 retracts to tilt the dipper 250 about the pivot point 285 such that the teeth 290 of the dipper 250 lower.

Figure 7A:
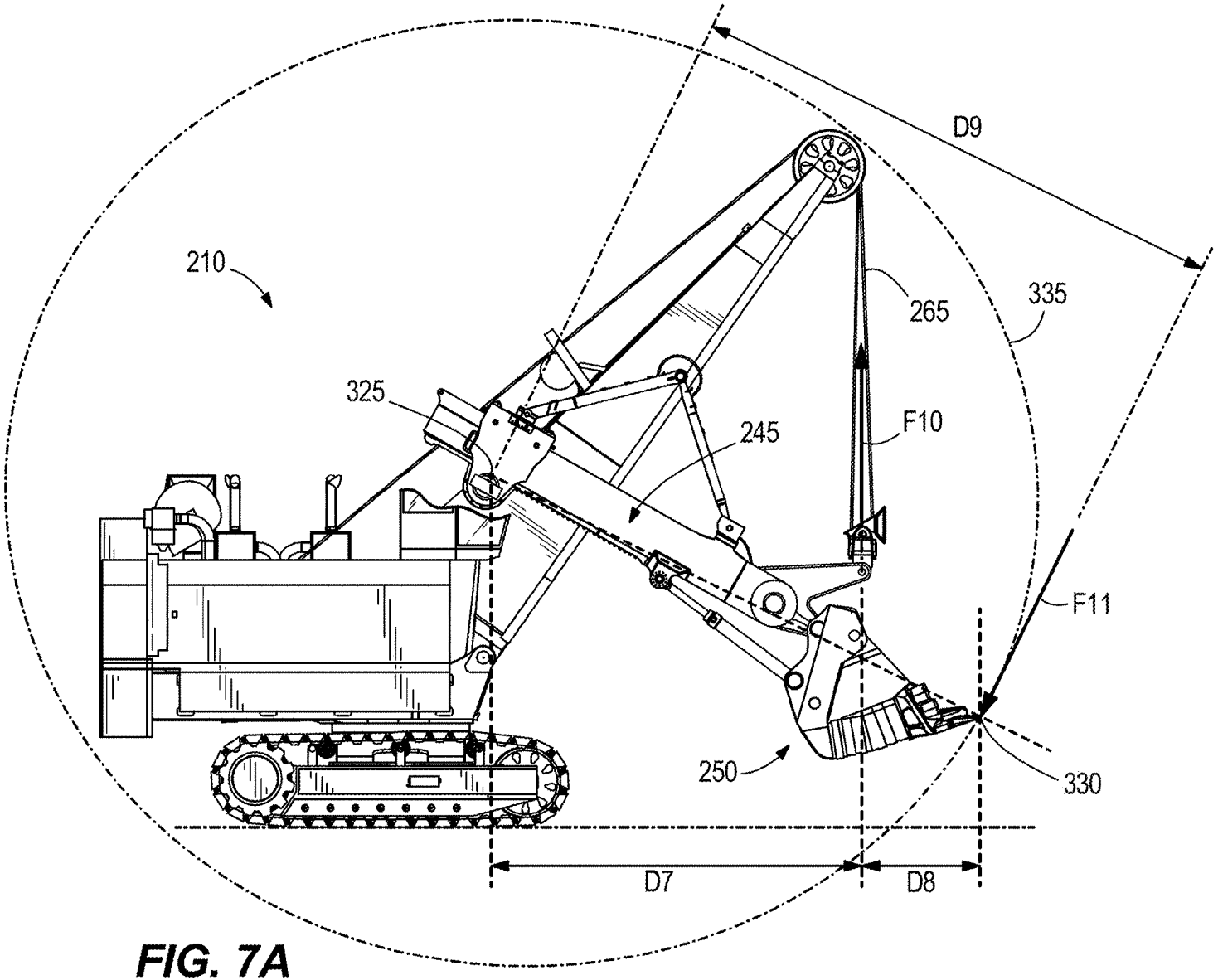
FIG. 7A is a side view of the mining machine of FIG. 7, illustrating a digging force vector and hoist bail pull vector.

When the dipper 250 is both fully extended (FIG. 9) and partially retracted (FIG. 10), the extension 295 does not impede or significantly interfere with operation of the dipper 250. In either position, and in any position therebetween, the dipper 250 is thus able to be thrust into a bank of material, and to remove material from the bank, without the extension 295 significantly (or in some constructions at all) interfering with the operation of the dipper 250. As illustrated in FIG. 8, for example, the dipper 250 includes an opening 320 adjacent the teeth 290. This opening 320 receives material from the bank. In the illustrated construction, the extension 295 extends slightly over a portion of this opening 320 in at least one position of the dipper 250 (e.g., such that an axis defined by the hoist rope guide 265 extends through into the opening as illustrated in FIGS. 7 and 7A), but still leaves a majority of the opening 320 open and exposed.

Thus, in the illustrated construction, the extension 295 is made to extend at least partially over the dipper 250, but not to an extent that any significant interference takes place with moving material into or out of the dipper 250 through the opening 320. At the same time, however, the extension 295 is made to extend as far as possible over the dipper 250 so as to provide the greatest efficiency and the greatest amount of available tooth digging force possible (i.e., higher digging forces are generated the closer a bail is to the dipper teeth). For example, and with reference to FIG. 9, a force F6 represents a force acting on the dipper 250 from the hoist rope 265 through the bail 255 and the equalizer 260. A force F7 represents a force that would otherwise act on the dipper 250 if the bail 255 and equalizer 260 were directly coupled to the dipper 250, like in FIGS. 1-6. As illustrated in FIG. 9, a distance D3 between the force F6 and the teeth 290 is less than a distance D4 between the force F7 and the teeth 290 (the distances D3 and D4 extending perpendicularly from F6 and F7, respectively, to a dashed line that is parallel to F6 and F7 and contacts the teeth 290). Because the distance D3 is less than D4, there is greater mechanical efficiency and available tooth digging force by directly coupling the bail 255 to the extension 295. In some constructions, the difference between the distance D3 and D4 is between approximately 30 inches and 37 inches. In some constructions, the difference between the distance D3 and D4 is between approximately 25 inches and 42 inches. Other constructions include different values and ranges.

Similarly, in FIG. 10 a force F8 represents a force acting on the dipper 250 from the hoist rope 265 through the bail 255 and the equalizer 260. A force F9 represents a force that would otherwise act on the dipper 250 if the bail 255 and equalizer 260 were directly coupled to the dipper 250 like in FIGS. 1-6. As illustrated in FIG. 10, a distance D5 between the force F8 and the teeth 290 is less than a distance D6 between the force F9 and the teeth 290 (the distances D5 and D6 extending perpendicularly from F8 and F9, respectively, to a dashed line that is parallel to F8 and F9 and contacts the teeth 290). Because the distance D5 is less than D6, there is greater mechanical efficiency and available tooth digging force by directly coupling the bail 255 to the extension 295. Thus, there is greater mechanical efficiency and available tooth digging force regardless of whether the dipper 250 is in the fully extended position (FIG. 9), a partially retracted position (FIG. 10), or any other position. In some constructions, the difference between the distance D5 and D6 is between approximately 10 inches and 14 inches. In some constructions, the difference between the distance D5 and D6 is between approximately 8 inches and 16 inches. The distances D5 and D6 also are influenced by rope angle, which is a function of crowd extension and handle angle. Thus, the distances D5 and D6 will vary, are not solely determined by tilt extension. Other constructions include different values and ranges.

Use of the extension 295 and the bail 255 coupled directly to the extension 295 also provides a number of additional advantages. For example, the dipper 250 can be made lighter and thereby cheaper than the dipper 55 described above, due to less overall loading and stress on the dipper 255 than the dipper 55. Fewer plates and/or welds may thus be used with the dipper 255.

Additionally, the negative load illustrated in FIG. 3 (i.e., the force F3) is greatly reduced on the power shovel 10. The gravity force F2 will still provide some negative load, but the tension force F1 will be eliminated, due to the hoist rope 265 pulling on the handle 245 (i.e., through the bail 255 and equalizer 260) instead of on the back of the dipper 255. The negative load on the tilt mechanism illustrated in FIG. 4 (i.e., the force F5) is completely eliminated on the power shovel 210, due to the removal of the tension force F4, provided there are no externally provided forces such as tooth forces from the bank (while digging) or material in the dipper (e.g. a gravity force of the dipper). Taken together, the fact that the negative loads are reduced in severity and frequency provides a significant reduction in the use of the high hydraulic back pressure described above. This ability to reduce back pressure provides a more efficient hydraulic operating system, as it reduces the amount of constant back pressure that must be applied in the cylinder to prevent cavitation and runaway. With reduced back pressure requirements, the tilt mechanism 280 is able to have increased peak pressures. In some constructions, due to the reduced back pressure requirements, the size of the tilt mechanism 280 may additionally or alternatively be reduced, thereby resulting in cost savings. In either manner, however, there is an increase in energy efficiency, since back pressure acts as a drag on hydraulic fluid flow, and this drag has been reduced through the use of the bail 255 being coupled directly to the extension 295.

With continued reference to FIGS. 7-10, the corner tooth loading on the dipper that will unavoidably occur during digging as described above has a load path that will bypass the bail connection into the handle 245. The effects of corner tooth loading on the bail connection is therefore reduced or completely eliminated on the power shovel 210, due to the bail 255 and the equalizer 260 being isolated from the dipper 250. Thus, the bail 255 and/or equalizer 260 may be made with less material and weight than the bail 55 and/or equalizer 60, providing added cost savings. In addition, the elimination of the bail load path through the dipper allows the dipper 255 to see less overall loading and stress than the dipper 55, providing additional weight and cost savings in the dipper 255.

Additionally, the handle drop illustrated in FIG. 5 is completely eliminated with the power shovel 210, since the handle 245 (and thus the bail 255 and the equalizer 260) does not move when the drive pinion and winch drum are not rotated and the dipper 250 is tilted. Rather, only the dipper 250 itself moves. Thus, because the dipper 250 is isolated from the bail 255 and the equalizer 260, and because the bail rope 265 is coupled directly to the equalizer 260, the bail rope 265 is not affected by the tilting movement of the dipper 250 and no rope slack results, nor handle drop results, regardless of whether the dipper is supported by the ground or not.

With reference to FIG. 7A, the shovel 210 also includes a handle pivot point 325, about which the handle 245 pivots. In some constructions, the handle pivot point 325 is defined as a point or area where a handle rack (e.g., similar to the rack and tooth formation 75 illustrated in FIG. 1) tangentially rests upon a shipper shaft pinion.

As illustrated in FIG. 7A, a hoist bail pull vector F10, acting along the hoist rope 265, generates a digging force vector F11 at a tip 330 of the dipper teeth. The direction of the digging force vector F11 is at a right angle to a dashed line that extends directly between the handle pivot point 325 and the tip 330 of the dipper teeth (the digging force vector F11 corresponding for example to the tooth digging forces DF1 and DF2 shown in FIG. 6). As illustrated in FIG. 7A, the digging force vector F11 is also tangent to an arc 335 of the dipper teeth rotating about the handle pivot point 325. In some constructions to generate these vectors a handle crowd effort and dipper tilt effort are not active but are passively resisting the reaction forces. If they were actively generating additional force and motion, it would affect the amplitude and direction of the resulting digging force vector F11 as defined at the tip 330 of the dipper teeth in this illustration.

With continued reference to FIG. 7A, a distance D7 is measured perpendicularly between two parallel dashed lines, the first of which passes through the handle pivot point 325 and the second of which extends along the hoist bail pull vector F10. A distance D8 is measured perpendicularly between the dashed line that extends along the hoist bail pull vector F10 and a parallel dashed line that extends through the tip 330 of the dipper teeth. A distance D9 is defined as the direct distance between the handle pivot point 325 and the digging force vector acting at the tip 330 of the dipper teeth.

With continued reference to FIG. 7A, there is a moment balance on the shovel 210 such that the magnitude of the hoist bail force vector F10 multiplied by the distance D7 is equivalent to the magnitude of the digging force vector F11 multiplied by the distance D9. The greater the digging force vector F11, the better the dipper 250 digs through a bank of material. Therefore, any geometry change that increases the digging force vector F11 without increasing the effort and energy required from any prime movers on the shovel 210 (e.g., crowd motors) makes the shovel 210 and the dipper 250 more efficient.

With continued reference to FIG. 7A, the greater the hoist bail pull vector F10, the greater the resulting digging force vector F11 available at the tip 330 of the dipper teeth. As the hoist bail pull vector F10 migrates closer to the tip 330 of the dipper teeth (and further away from the handle pivot point 325) the amplitude of the resulting digging force vector F11 increases without having to increase prime mover effort and energy. That is, as D7 gets larger and D8 gets smaller in magnitude, the resulting digging force vector F11 at the tip 330 of the dipper increases, and digging becomes more efficient.

With reference to FIGS. 9 and 10, a handle angle in each figure is about 30° from horizontal which corresponds to a typical handle angle as an operator finishes an initial thrust into a bank of material and is about to now tilt and hoist out of the bank of material with a dipper full of material. It is at this point in the dig cycle that the operator may want full effort to pull the filled dipper out of the bank of material. In some constructions, a 30° fully extended handle therefore is where optimization of the available digging force vector F11 at the tip 330 of the dipper teeth may occur.

Figure 12:
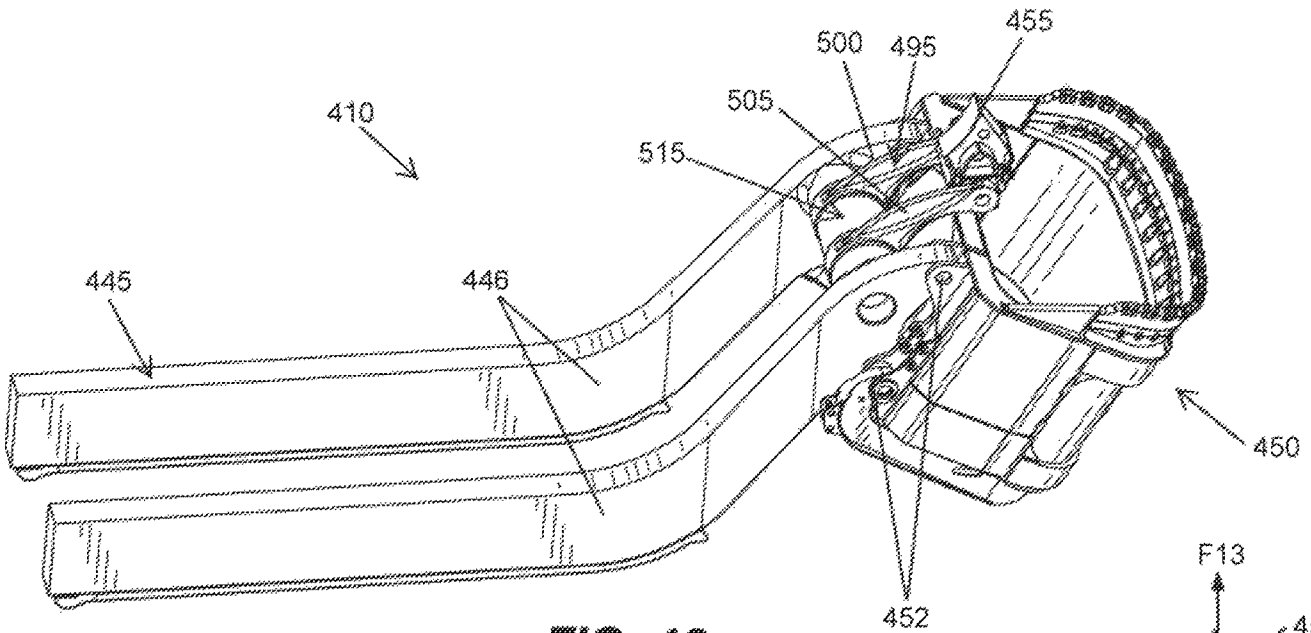

FIGS. 11-15 illustrate a shovel 410. The shovel 410 is similar to the shovel 210 described above. Thus, like components are referenced by the same number increased by 200. The shovel 410, however, does not include a hydraulic tilt mechanism for its dipper 450. Rather, the dipper 450 is rigidly fixed to the handle 445 at connection points 452 along the handle 445. In this construction, the extension 495 of the handle 445 is coupled to (e.g., directly coupled via welding or integrally formed as a single piece with) the torsion tube 515 of the handle 445, and the bail 455 is coupled to the extension 495 (i.e., to both arms 500, 505 of the extension 495 as illustrated in FIG. 12), such that the bail 455 is isolated from the dipper 450. As illustrated in FIG. 12, the handle 445 itself is non-linear, and is bent at locations 446. In some constructions, the bent, non-linear handle 445 increases tuck-ability and flat floor clean-up range for the rigidly-connected dipper 450. Additionally, as illustrated in FIG. 12, the first arm 500 and the second arm 550 of the extension 495 each extend directly from the torsion tube 515.

Figure 13:
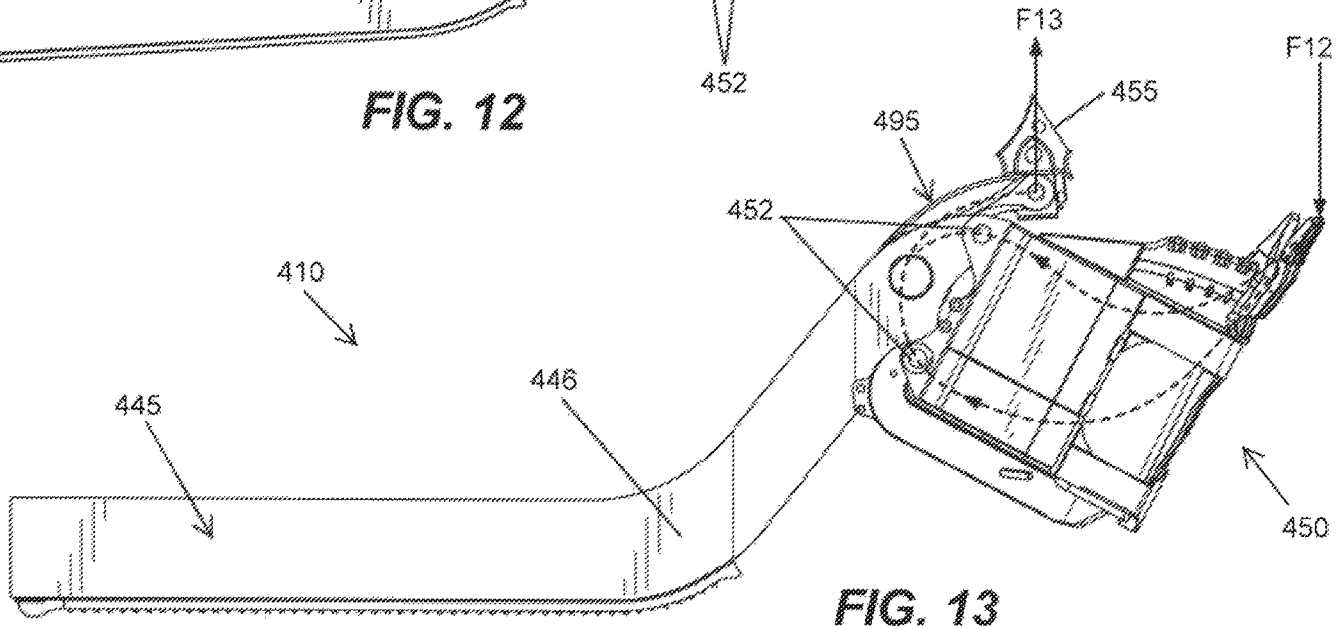
Figure 14:
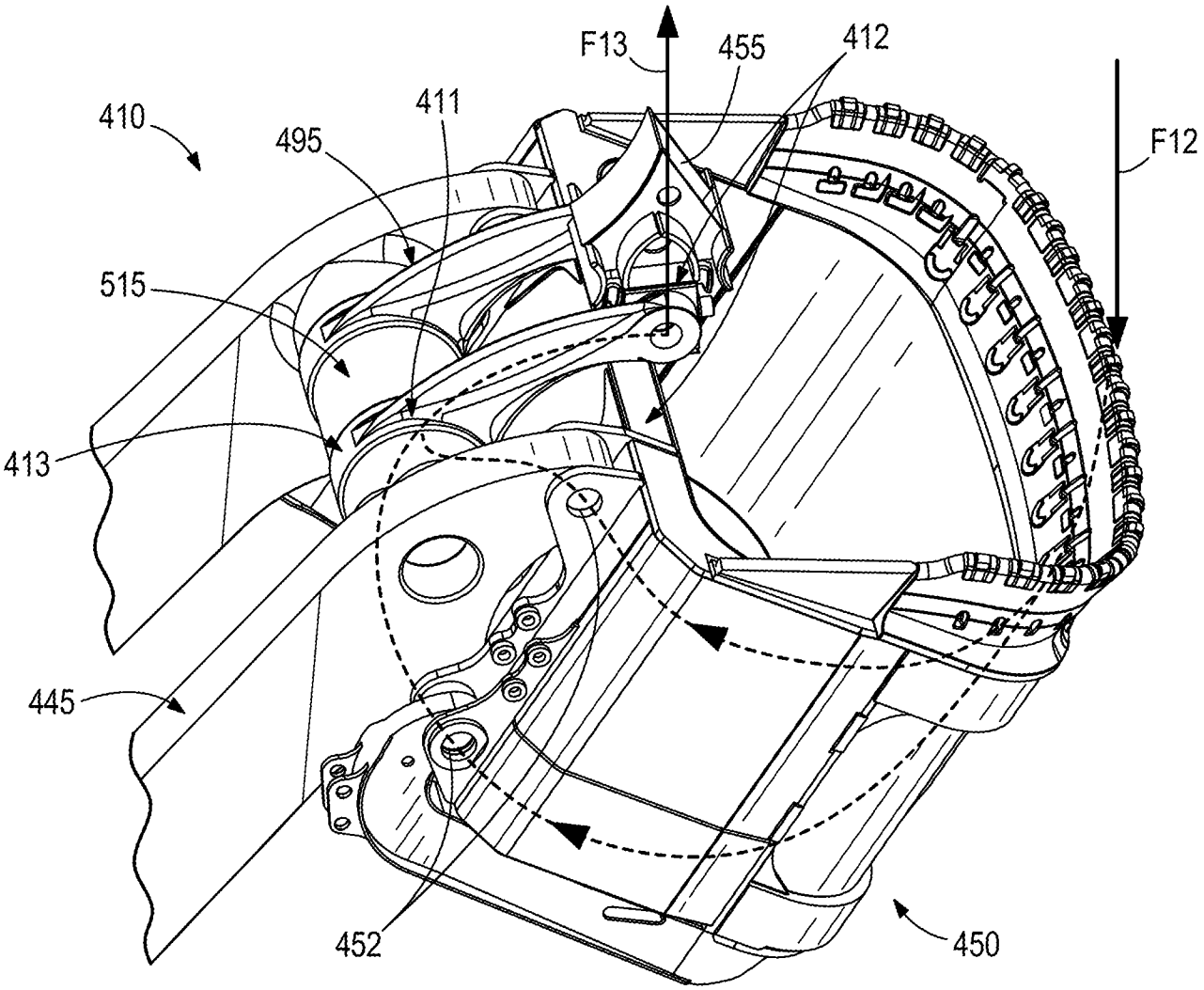

FIGS. 13 and 14 illustrate a center tooth loading path generated by a digging force F12 at a central tooth along the lip of the dipper 450 (the force F13 representing the force being applied by the hoist rope). As illustrated in FIG. 14, heavy bending/torsion may occur at a location 411 (e.g., at a base of the extension 495). The torsion tube 515 may take on a significant role in resisting bending moments and shear loads. Bending in the bail 455 and a back of the dipper 450 may be minimized at locations 412. As illustrated in FIG. 14, one of the locations 412 is a back of the dipper 450 and another of the locations 412 is an interface between the bail 455 and the extension 495 (e.g., a bail pin under shear and bending load and whose bending load is minimized because the bail 455 no longer reaches from one side of the dipper 450 to the other). A center tooth load path (dashed line) generated by the digging force F12 may be driven through the torsion tube 515 at a location 413. The torsion tube 515 may absorb most of the bending and torsion that occurs as a result of this center tooth load path. In some constructions, the torsion tube 515 may be increased in mass to facilitate absorbing these loads. The torsion tube 515 is more conducive to absorbing the heavier loading due to its large section property to resist such loads.

Figure 15:
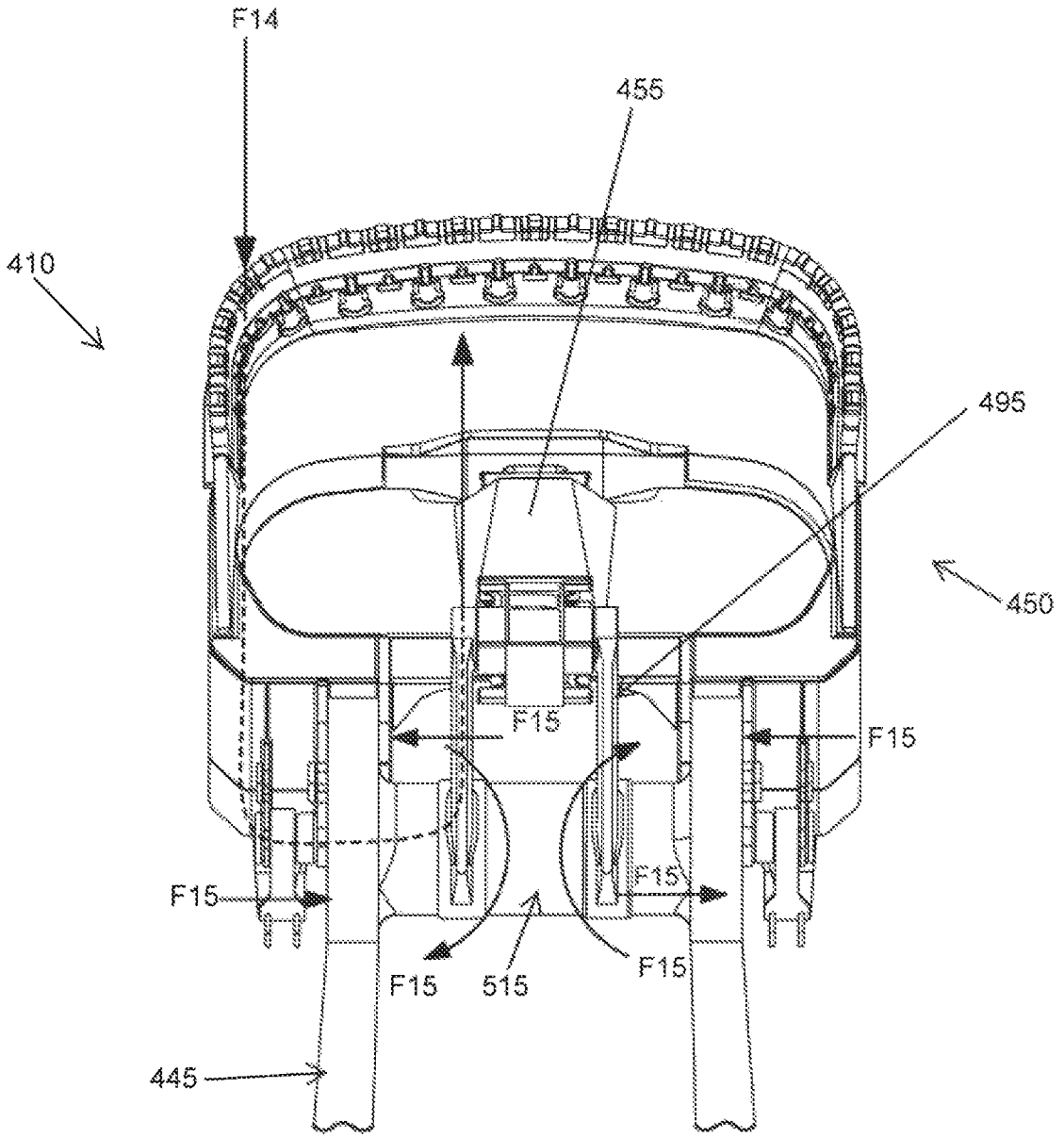

FIG. 15 illustrates a corner tooth loading F14 of the dipper 450, and resulting reaction forces F15 on components of the shovel 510. As illustrated in FIG. 15, a load flow path (dashed line) from the loading F14 follows along a generally U-shaped direction, thus resulting in two changes of direction. The torsion tube 515 absorbs a substantial amount of the bending moment generated by the loading F14.

Figure 16:
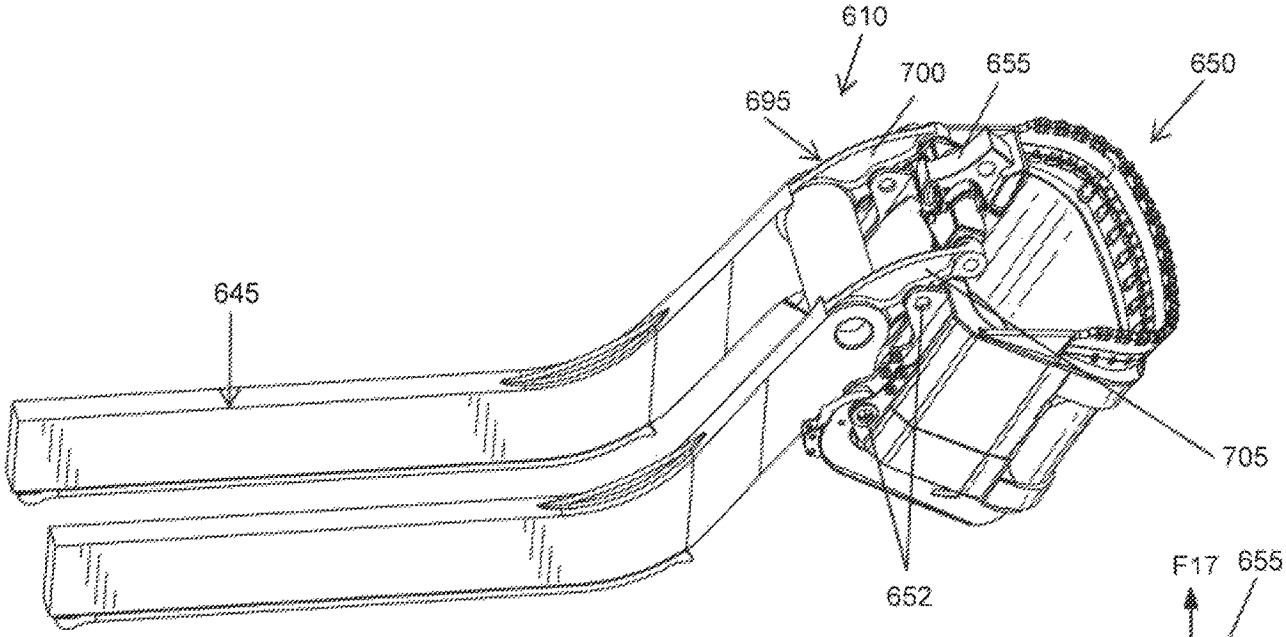
FIGS. 16-19 are perspective view of a mining machine according to another construction Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

FIGS. 16-19 illustrate a shovel 610. The shovel 610 is similar to the shovel 210 described above. Thus, like components are referenced by the same number increased by 400. Similar to the shovel, 410, the shovel 610 does not include a hydraulic tilt mechanism for its dipper 650. Rather, the dipper 650 is rigidly fixed to the handle 645 at connection points 652 along the handle 645 and the extension 695. As illustrated in FIG. 16, the bail 655 is coupled (e.g., directly coupled) to the extension 695 at an end of the extension 695 and between the arms 700, 705 of the extension 695, such that the bail 655 is isolated from the dipper 650.

Figure 17:
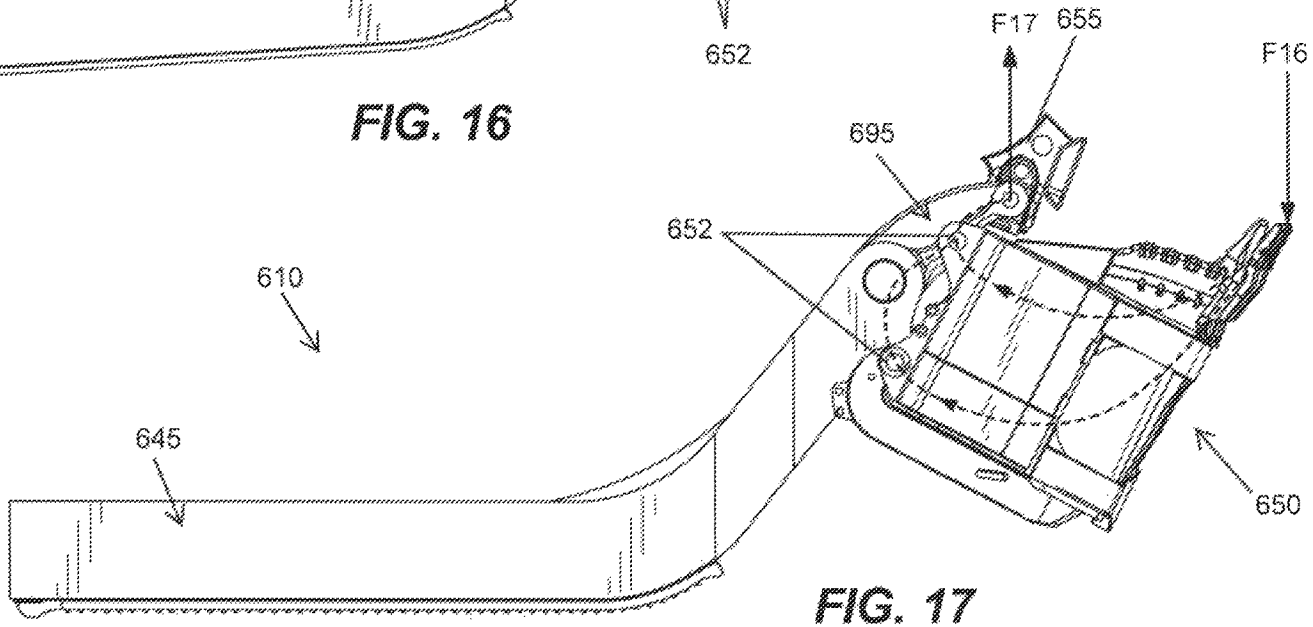
Figure 18:
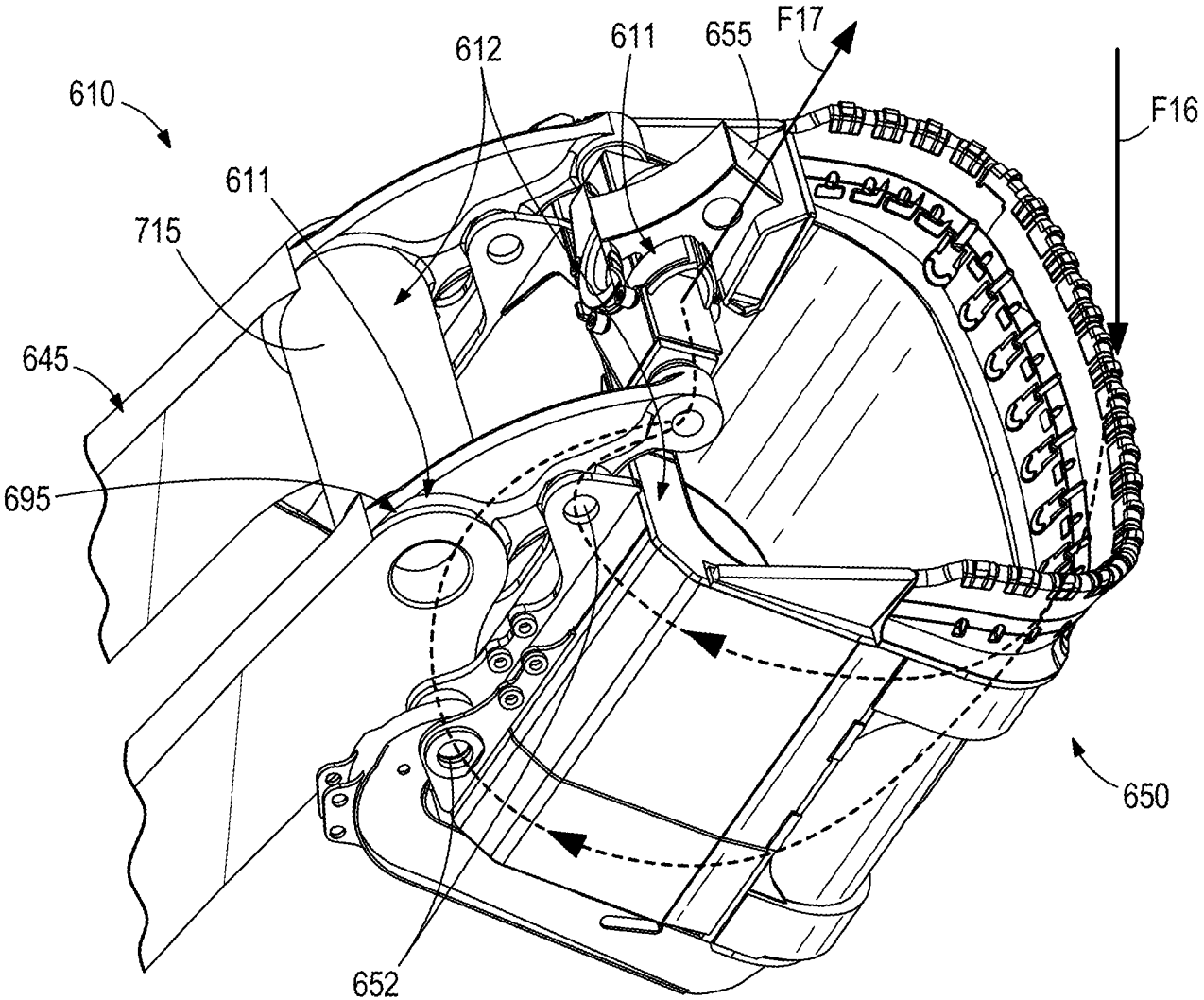

FIGS. 17 and 18 illustrate a center tooth loading path generated by a digging force F16 at a central tooth along the lip of the dipper 650 (the force F17 representing the force being applied by the hoist rope). As illustrated in FIG. 18, heavy bending may occur at locations 611 (e.g., in the bail 655 and the extension 695). Bending in a back of the dipper 650 may be minimized at locations 612, as the bail 655 and the extension 695 take on bending moments and shear loads. In some constructions, bending in the torsion tube 715 may also be minimized. A center tooth load path (dashed line) may be driven through the handle 645 and into the bail 655. The bail 655 and the extension 695 may absorb most of the bending that occurs as a result of this center tooth load path.

Figure 19:
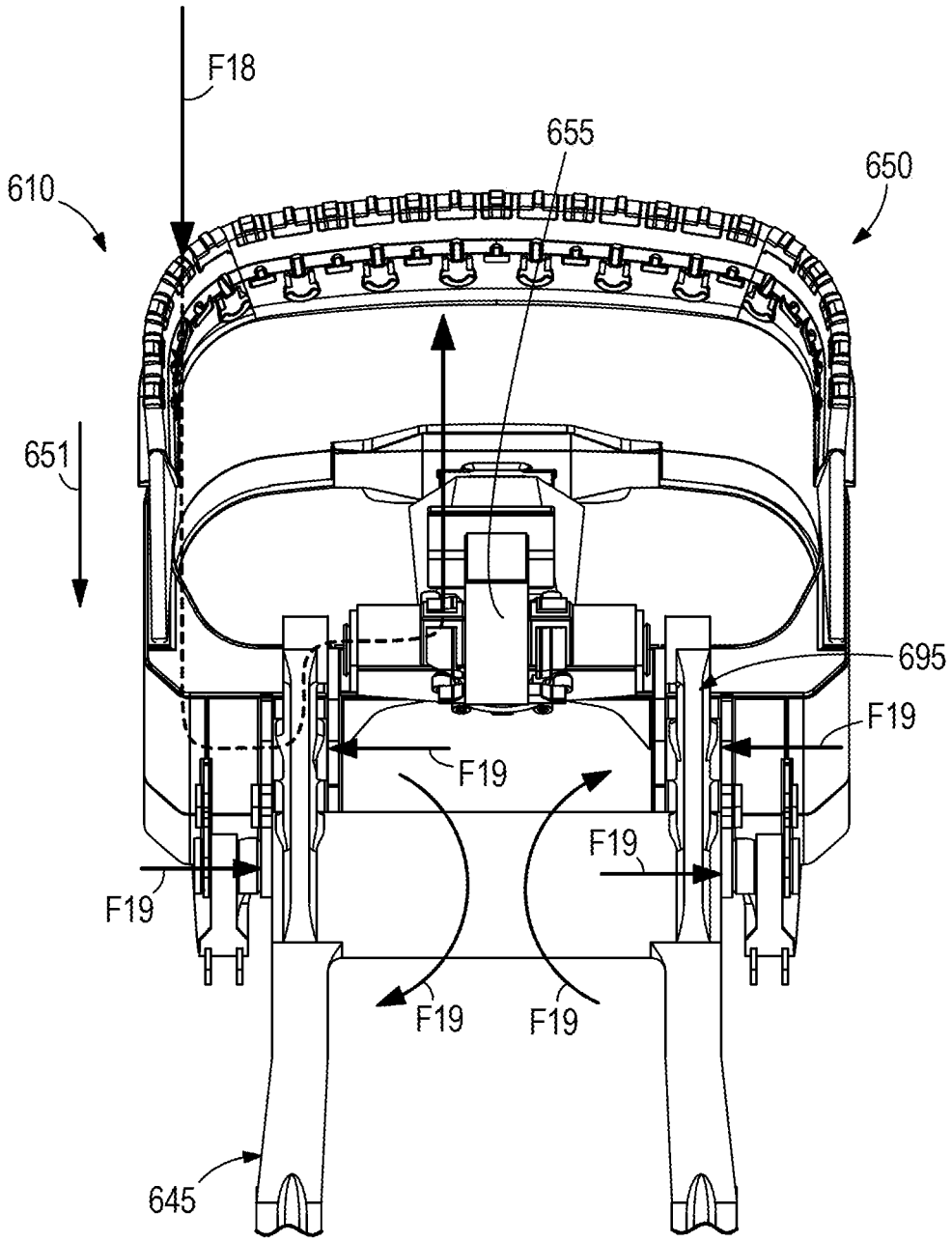

FIG. 19 illustrates a corner tooth loading F18 of the dipper 650, and resulting reaction forces F19 on components of the shovel 610. As illustrated in FIG. 19, the load flow path (dashed line) from the loading F17 follows along various directions, resulting in four changes of direction. The handle extension 695 and the bail 655 absorb a substantial amount of the bending moment generated by the loading F17. As illustrated in FIGS. 15 and 19, the load flow path in the construction of FIG. 19 does not extend as far rearward (the rearward direction being illustrated by direction 651) as in the construction of FIG. 15. Thus, in the construction of FIG. 19 the bail 655 and the extension 695 may be made heavier or stronger, whereas in the construction of FIG. 15 the torsion tube 515 may be made heavier or stronger. As illustrated in FIGS. 17-19, the loading paths are generally more circuitous than the loading paths for the construction of FIGS. 13-15.

With reference to FIGS. 11-19, the extensions 495, 695 fully take over the flow paths of hoist vector components directly into the handles 445, 545, and not through the dippers 450, 650. Thus, the dippers 450, 650 do not experience loads from the hoist ropes. Rather, the hoist ropes pull directly on the handles 445, 645, such that the handles 445, 645 experience the loads from the hoist ropes. In some constructions, this arrangement permits the dippers 450, 650 to be formed with less mass and constructed with less cost, as the dippers 450, 650 no longer require structure to support loads from the hoist ropes. In some constructions, this arrangement allows for increased structural mass to be shifted from the back of the dipper 450, 650 (i.e., where the structural mass was used to support the loads from the hoist ropes) for example to the torsion tube (e.g., torsion tube 515) and base of the handle extension (e.g., extension 495). Instead of heavier construction at the back of the dipper 450, 650, the heavier construction is thus placed further rearward because loads will be driven rearward in these areas. Between the two constructions of FIGS. 11-15 and 16-19, the construction of FIGS. 11-15 drives the mass back further, due to the bail being attached to the torsion tube. The rearward shift illustrated in FIGS. 11-19 allows for higher digging forces at a tip of the dipper lip (e.g., at the teeth), and/or a reduction in shovel counterweights (e.g., due to greater mass being closer to a centerline of the shovel), and/or less swing inertia that the shovel has during swing, resulting in more responsive starts/stops.

Additionally, and as described above, when the construction of FIGS. 11-15 is used the corner tooth loading pushes the load flow path back far enough such that the torsion tube 515 absorbs a significant amount of the load. The torsion tube 515 may be formed with an increased mass to absorb the loading, and the bail 655 and the dipper 650 may thus be made lighter (e.g., by using a decreased width for the bail 655, or an overall smaller bail 655 or dipper 650). In some constructions, the structure of the dipper 650 itself may be reduced (e.g., full box sections may be reduced in favor of an open gusset structure). In some constructions, the dipper 450, 650 is a fast wear item that is frequently replaced. The lighter the construction, the less the cost.

Although the invention has been described in detail with reference to certain preferred embodiments, variations and modifications exist within the scope and spirit of one or more independent aspects of the invention as described.

What is claimed is:

1. A mining machine comprising:
a frame;
a boom coupled to the frame;
a handle coupled to the boom; and
a dipper coupled to the handle;
wherein the handle includes an extension, and wherein a bail is coupled directly to the extension, such that the bail is isolated from the dipper and a bail load path does not pass through the dipper, wherein the dipper includes teeth and an opening adjacent the teeth to receive material, wherein the extension extends over a portion of the opening.

2. The mining machine of claim 1, wherein the extension is integrally formed as a single piece with a rest of the handle, such that the extension and a rest of the handle form a single rigid structure.

3. The mining machine of claim 1, wherein the extension includes a first arm and a second arm, wherein both the first arm and the second arm are pivotally coupled to the bail.

4. The mining machine of claim 3, wherein the bail is disposed between the first arm and the second arm.

5. The mining machine of claim 3, wherein the first arm and the second arm extend parallel to one another.

6. The mining machine of claim 3, wherein the first arm and the second arm both have a curved profile.

7. The mining machine of claim 3, wherein the handle includes a torsion member, and wherein the first arm and the second arm each extend directly from the torsion member.

8. The mining machine of claim 1, wherein the mining machine includes a tilt mechanism coupled to both the handle and the dipper.

9. The mining machine of claim 8, wherein when the tilt mechanism is activated in a first direction, the tilt mechanism is configured to extend the dipper about a pivot point such that teeth of the dipper rise.

10. The mining machine of claim 9, wherein when the tilt mechanism is activated in a second direction, the tilt mechanism is configured to retract to tilt the dipper about the pivot point such that the teeth of the dipper lower.

11. The mining machine of claim 1, wherein the handle has a non-linear profile.

12. The mining machine of claim 1, wherein a sheave is coupled to an end of the boom, wherein an equalizer is coupled to the bail, and wherein a hoist rope is coupled to the equalizer and to the sheave.

13. The mining machine of claim 1, wherein the dipper is rigidly fixed to the handle.

14. The mining machine of claim 1, wherein the mining machine is an electric shovel.

15. The mining machine of claim 1, further comprising:
a sheave coupled to an end of the boom;
wherein the dipper is rigidly coupled to the handle;
wherein the handle has a non-linear profile, wherein an equalizer is coupled to the bail, and wherein a hoist rope is coupled to the equalizer and to the sheave.

16. The mining machine of claim 15, wherein the dipper includes teeth and an opening adjacent the teeth to receive material, wherein the extension extends over a portion of the opening.

17. The mining machine of claim 15, wherein the extension includes a first arm and a second arm, wherein both the first arm and the second arm are pivotally coupled to the bail.

18. The mining machine of claim 17, wherein the bail is disposed between the first arm and the second arm.

19. The mining machine of claim 17, wherein the first arm and the second arm extend parallel to one another.

20. The mining machine of claim 17, wherein the handle includes a torsion tube, and wherein the extension extends directly from the torsion tube.

21. A mining machine comprising:
a frame;
a boom coupled to the frame;
a handle coupled to the boom; and
a dipper coupled to the handle;
wherein the handle includes an extension, wherein a bail is coupled directly to the extension, such that the bail is isolated from the dipper, wherein the extension includes a first arm and a second arm, wherein both the first arm and the second arm are pivotally coupled to the bail, wherein both the first arm and the second arm have a curved profile.

22. A mining machine comprising:
a frame;
a boom coupled to the frame;
a handle coupled to the boom; and
a dipper coupled to the handle;
wherein the handle includes an extension, wherein a bail is coupled directly to the extension, such that the bail is isolated from the dipper, wherein the extension includes a first arm and a second arm, wherein both the first arm and the second arm are pivotally coupled to the bail, wherein the handle additionally includes a torsion member, and wherein the first arm and the second arm each extend directly from the torsion member.

* * * * *